US011819752B1

(12) United States Patent
Sanders

(10) Patent No.: US 11,819,752 B1
(45) Date of Patent: Nov. 21, 2023

(54) ORAL DEVICE TO PROTECT THE TONGUE OF A USER, AND METHODS OF USE

(71) Applicant: NeuroVice, L.L.C., Cary, NC (US)

(72) Inventor: Ashlyn Sanders, Cary, NC (US)

(73) Assignee: NeuroVice, L.L.C., Wake Forest, NC (US)

( * ) Notice: Subject to any disclaimer, the term of this patent is extended or adjusted under 35 U.S.C. 154(b) by 447 days.

(21) Appl. No.: 15/875,670

(22) Filed: Jan. 19, 2018

Related U.S. Application Data

(60) Provisional application No. 62/511,604, filed on May 26, 2017, provisional application No. 62/448,005, filed on Jan. 19, 2017.

(51) Int. Cl.
*A63B 71/08* (2006.01)

(52) U.S. Cl.
CPC ..... *A63B 71/085* (2013.01)

(58) Field of Classification Search
CPC .. A63B 71/085; A61B 13/00; A61M 16/0495; A61M 16/049; A61M 16/0493; A61M 2210/0643; A61M 16/0488; A61C 5/90; A61C 7/008; A61C 17/10; A61C 17/06; A61F 5/56
USPC ..... 128/848, 859
See application file for complete search history.

(56) References Cited

U.S. PATENT DOCUMENTS 2,168,712 A 8/1939 Lohner et al.
3,217,708 A 11/1965 Roberts
3,971,370 A 7/1976 Halford et al.
4,041,937 A 8/1977 Diaz
4,304,227 A 12/1981 Samelson
5,586,562 A * 12/1996 Matz ..... A61F 5/56 128/859
5,692,493 A 12/1997 Weinstein et al.
(Continued)

FOREIGN PATENT DOCUMENTS

DE 202004020196 U1 * 6/2005 ..... A61C 7/08
EP 3326580 A1 5/2018
KR 20180116089 A * 10/2018

OTHER PUBLICATIONS

International Search Report and Written Opinion for International Application No. PCT/US2021/054584, dated Mar. 1, 2022, 14 pages.

(Continued)

*Primary Examiner* — Kim M Lewis
(74) *Attorney, Agent, or Firm* — COOLEY LLP

(57) ABSTRACT

Apparatus and methods are described herein for preventing injury to the tongue of a user. An oral device can include a tongue protector configured to be disposed beneath the tongue of a user and having a tongue receptacle configured to receive the tip of the tongue of the user and cover a distal portion of the top surface of the tongue. The oral device can also include a left tooth protector and a right tooth protector configured to be disposed over only the left lower molars and canine and the right lower molars and canine of the user, respectively. A left coupler and a right coupler can couple the left tooth protector and the right tooth protector, respectively, to the tongue protector. The left coupler and the right coupler can be configured to allow limited movement of the tongue protector while retaining the tongue protector in the user's mouth.

20 Claims, 15 Drawing Sheets

(56) References Cited

U.S. PATENT DOCUMENTS

| | | | | |
|---|---|---|---|---|
| 6,319,510 | B1 * | 11/2001 | Yates | A61P 1/14 424/404 |
| 6,422,243 | B1 * | 7/2002 | Daram | A61F 5/0006 128/859 |
| 6,572,569 | B2 * | 6/2003 | Klein | A44C 15/0035 601/69 |
| 7,607,439 | B2 * | 10/2009 | Li | A61F 5/566 433/7 |
| 7,963,286 | B2 | 6/2011 | Burdumy | |
| 8,028,705 | B2 | 10/2011 | Li | |
| 8,251,069 | B2 | 8/2012 | Burdumy et al. | |
| D666,726 | S | 9/2012 | Davis et al. | |
| 8,347,890 | B2 | 1/2013 | Li | |
| 8,474,462 | B2 * | 7/2013 | Makower | A61F 5/566 128/860 |
| 8,656,925 | B2 | 2/2014 | Davis et al. | |
| 9,370,707 | B2 | 6/2016 | Schwank et al. | |
| 9,630,082 | B2 | 4/2017 | Zents | |
| 2002/0117178 | A1 | 8/2002 | Dort | |
| 2006/0096600 | A1 | 5/2006 | Witt et al. | |
| 2007/0015113 | A1 | 1/2007 | Lavi et al. | |
| 2007/0289600 | A1 | 12/2007 | Li | |
| 2009/0038624 | A1 | 2/2009 | Akervall et al. | |
| 2009/0217931 | A1 | 9/2009 | Davies et al. | |
| 2010/0083970 | A1 | 4/2010 | Beely et al. | |
| 2010/0227289 | A1 * | 9/2010 | Farrell | A61C 7/10 433/6 |
| 2013/0068235 | A1 | 3/2013 | Makower et al. | |
| 2014/0076335 | A1 | 3/2014 | Morgan | |
| 2014/0166024 | A1 | 6/2014 | Davidson et al. | |
| 2014/0238417 | A1 | 8/2014 | Turkbas | |
| 2016/0067073 | A1 | 3/2016 | Carotenuto | |
| 2016/0135922 | A1 | 5/2016 | Rampello | |
| 2016/0250544 | A1 | 9/2016 | Evans et al. | |
| 2017/0087003 | A1 * | 3/2017 | Luco | A61F 5/566 |
| 2018/0085247 | A1 | 3/2018 | Trainor et al. | |
| 2019/0374734 | A1 | 12/2019 | Garner | |

OTHER PUBLICATIONS

Invitation to Pay Additional Fees for International Application No. PCT/US2021/054584, dated Dec. 8, 2021, 2 pages.

* cited by examiner

ORAL DEVICE TO PROTECT THE TONGUE OF A USER, AND METHODS OF USE

CROSS-REFERENCE TO RELATED APPLICATIONS

This application claims priority to and the benefit of U.S. Provisional Application No. 62/448,005, filed Jan. 19, 2017, entitled "Oral Device to Protect the Tongue of a User, and Methods of Use," and U.S. Provisional Application No. 62/511,604, filed May 26, 2017, entitled "Oral Device to Protect the Tongue of a User, and Methods of Use," the entire contents of which are hereby expressly incorporated by reference for all purposes.

BACKGROUND

Embodiments described herein relate to devices and methods for preventing trauma and injury to the tongue of a user experiencing a seizure or other neurologic event characterized by excessive and/or uncontrolled movements, and minimizing excessive salivation by the user, while posing minimal hazard to the user.

Movement disorders are defined as neurologic conditions in which there are abnormal, uncontrolled movements. For example, tremors are a type of movement disorder. Diseases of the central nervous system, such as Parkinson's disease, can cause many movement disorders or symptoms of movement disorders characterized by a loss of control over posture and limb movements. Neurologic conditions in which there is a disturbance of brain function can also result in seizures and symptoms akin to those defined by movement disorders. Seizures are most commonly associated with epilepsy, which as a diagnosis, has a complex collection of symptoms. People with epilepsy have a continuing tendency to have seizures which cause disturbances in mental function, consciousness, sensory perception, and body movements. Seizures, convulsions and other spasmodic attacks are not necessarily epileptic in nature and can be a secondary response to an alternative, underlying neurologic condition. Other causes of seizures or convulsions include injuries, autoimmune diseases, infections, and negative responses to certain medicines. Seizures, convulsions, and other spasmodic attacks are generally diagnosed based on the history of the patient's symptoms, in conjunction with neurological exams, (i.e. EEG, MRI).

Disturbances in brain function, movement disorders and seizure induced complications can include injuries to parts of the body that are affected during episodes. Tongue biting is a common injurious consequence that can result from uncontrollable shaking and movements of the body, including the mouth. Additionally, seizures are frequently associated with excessive salivation and sialorrhea or drooling. During tonic-clonic seizures, the most common form of seizures, the jerking movements that may occur during the seizure poses a high risk of trauma or injury to the tongue and hypersalivation, which may result in foaming at the mouth or drooling. The tightening of jaw and face muscles during seizures may cause the person to bite down incessantly in the form of a chewing motion. These symptoms increase the likelihood of an unintentional injury to the tongue. Neurologic conditions in which tongue biting and/or drooling may occur include, but are not limited to: epilepsy, Parkinson's disease, traumatic brain injury (TBI), eclampsia, cerebral palsy, stroke, hypoglycemia, syncope, psychogenic seizures (PNES), and brain tumors. All of the aforementioned conditions represent forms of movement disorders, seizures, or are characterized by the possibility of having seizures, which increases the likelihood of tongue biting. Tongue biting is a physical finding associated with seizures, more specifically, a diagnosis of epilepsy. In addition to epilepsy, tongue biting is a consequence or concomitant of other rare neurological disorders such as conversion disorder, ataxia, choreaacanthocytosis, and tardive dyskinesia.

The most common of the aforementioned conditions include: epilepsy, Parkinson's disease, stroke, syncope, post-traumatic seizures from TBI, and PNES. According to the Epilepsy Foundation, approximately 3 million people have epilepsy in the United States, and 65 million people suffer from epilepsy worldwide. According to Citizens United for Research in Epilepsy (CURE), each year roughly 200,000 new cases of epilepsy will be diagnosed, with a higher incidence in young children and older adults. Additionally, it is estimated that between 30-45% of people with epilepsy do not respond to medication and thus suffer from intractable or refractory seizures. According to the Parkinson's Disease Foundation, Parkinson's disease affects about 1 million people in the United States and more than 4 million people worldwide. About 60,000 people are diagnosed each year in the United States. The Heart and Stroke Association estimates that approximately 800,000 people experience a stroke per year in the United States, and is a leading cause of serious, long-term disability, (i.e. paralysis of limbs and limited ability to perform autonomic functions). Approximately 1 million people are evaluated and treated for syncope in the United States each year. TBI affects roughly 2 million people per year in the United States and the Epilepsy Foundation estimates that the prevalence rate of PNES is comparable to that of multiple sclerosis. The cost of caring for epilepsy in the United States, including medications and first-aid treatment, accounts for approximately $15.5 billion each year. The indirect costs associated with uncontrolled seizures are seven times higher than that of the average for all chronic diseases.

Healthcare professionals continue to advise that no objects be placed in a person's mouth that is seizing. This is due to the risk of the patient breaking and/or swallowing the object and/or their teeth. Additionally, an object may also obstruct the person's respiration and/or ability to salivate appropriately. The most important thing to do during a seizure is to protect the person experiencing the seizure. Unfortunately, there are limited products and means with which to prevent oral injury and protect those who experience seizures. As such, the severity and pain associated with tongue lacerations have left patients who experience seizures limited options of protecting their tongues. As one of the most sensitive organs of the body, trauma or injury to the tongue causes great discomfort to patients and may impede their ability to talk and eat. Injuries to the tongue can create additional anxiety and feelings of embarrassment for patients with epilepsy and other movement disorders. While it is advised that nothing be placed in the mouth of a patient seizing, as a remedy, some patients have resorted to the use of traditional dental guards, mouthguards, bite blocks, and the like to prevent injury to the tongue. These devices are medically and financially unsuitable for seizure/movement disorder patients to use in preventing injury. They are designed with the primary functionality of protecting teeth and as such, the configuration of the devices require expensive, specialty fitting, and are bulky and uncomfortable. Furthermore, dental appliances made for dental applications are commonly made of materials or polymers that are not conducive to the compressive forces between the jaws during a seizure and thus, result in deformation or penetrability of the objects. This increases the risk of the dental appliance becoming dislodged, causing a choking or swallowing hazard. These products also fail to adequately prevent hypersalivation or drooling. The structural design of these oral devices are suitable for their aforementioned utility, and are thus unsuitable for seizure/movement disorder patients based on the nature of the physical symptoms associated with seizures/movement disorders. There is a need for a medical device that is specifically designed to prevent trauma and injury to the tongue, and minimize excessive salivation, while posing minimal hazard to patients while they are experiencing a seizure.

SUMMARY

Apparatus and methods are described herein for preventing trauma and injury to the tongue of a user experiencing a seizure or other neurologic event characterized by excessive and/or uncontrolled movements, and minimizing excessive salivation by the user, while posing minimal hazard to the user. In some embodiments, an oral device can include a tongue protector configured to be disposed beneath the tongue of a user. The oral device can have a tongue receptacle configured to receive the tip of the tongue of the user and cover a distal portion of the top surface of the tongue. The oral device can also include a left tooth protector configured to be disposed over only the left lower molars and canine of the user and a right tooth protector configured to be disposed over only the right lower molars and canine of the user. A left coupler can be coupled to the left tooth protector and the tongue protector and a right coupler can be coupled to the right tooth protector and the tongue protector. The left coupler and the right coupler can be configured to allow limited relative movement of the tongue protector with respect to the left tooth protector and the right tooth protector while retaining the tongue protector in the user's mouth.

DETAILED DESCRIPTION

An oral device and method of use are disclosed that provide both a structural and functional response for the problem of tongue biting (during seizures and other conditions in which the body experiences spasmodic attacks, jerking, teeth clenching, uncontrollable movements that increase the likelihood of biting the tongue), and hypersalivation. The device is cost effective, has simple structure, safe (clinical) use, and easily inserts in the mouth. It is both a clinical and household aid in preventing trauma and injury to the tongue and hypersalivation during seizures.

The oral device protects the tongue during seizures/movement disorders and mitigates the trauma created from the chewing motion of the upper and lower teeth, specifically the molars and canines. The configuration and material used to create the device is based on research regarding how seizures present (the physical symptoms that occur during seizures), and how these symptoms affect the interaction between the teeth and the tongue of a patient who seizes. The configuration of the device is based on the anatomical physiology of the mouth, teeth, and tongue.

Figure 1:
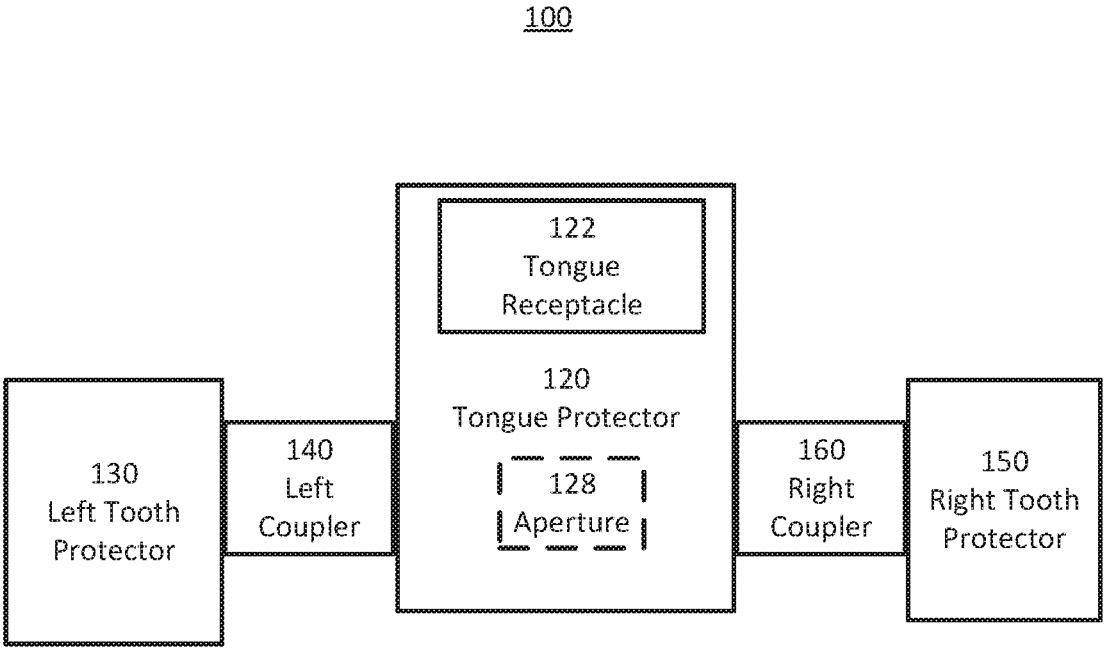
FIG. 1 is a schematic illustration of an oral device, according to an embodiment.

FIG. 1 is a schematic illustration of an oral device 100. The oral device 100 includes a tongue protector 120, a left tooth protector 130, and a right tooth protector 150. The left tooth protector 130 and the right tooth protector 150 are coupled to the tongue protector 120 via a left coupler 140 and a right coupler 160, respectively.

The tongue protector 120 includes a tongue receptacle 122 in which the tip of a user's tongue can be disposed during use. In some embodiments, the tongue protector 120 can be shaped such that the tongue protector 120 includes a rounded front portion (e.g., formed by the tongue receptacle 122) intended for engagement with the tip of the user's tongue and a back portion intended for engagement with the top side of the user's tongue. The back portion can have any suitable shape, such as, for example, a rectangular shape. In some embodiments, the tongue protector 120 can be U-shaped. In some embodiments, the tongue protector 120 can have a shape corresponding to a user's tongue. The back portion can also include a rear cut out (not shown) having any suitable shape, such as, for example, a triangular cut out or a rounded cut out.

The tongue protector 120 and the tongue receptacle 122 can have any suitable length and width. For example, in some embodiments, the tongue protector 120 can be shaped and sized such that the tongue protector 120 can enclose the bottom side of the user's tongue and half of the length of the top side of the user's tongue. In some embodiments, the tongue protector 120 can be shaped and sized such that the tongue receptacle 122 can enclose only a front portion of the user's tongue such that less than the entire bottom side of the user's tongue is enclosed and the tongue protector 120 can extend over less than half of the length of the top side of the user's tongue. In some embodiments, the tongue protector 120 can be shaped and sized such that the tongue receptacle 122 can enclose only a front portion of the user's tongue such that less than the entire bottom side of the user's tongue is enclosed and the tongue protector 120 can extend over half or more than half of the length of the top side of the user's tongue. In some embodiments, the tongue protector 120 cannot include a tongue receptacle 122 and only contact the top side of a user's tongue in use. In some embodiments, the tongue receptacle 122 have a length (e.g., the length of the tongue receptacle extending along the center of the tongue of the user) can be half as long as the length of the tongue protector 120 including the tongue receptacle 122. In some embodiments, the tongue receptacle 122 can have a length that is less than or more than half the length of the tongue protector 120.

With respect to the width of the tongue protector 120, in some embodiments the tongue protector 120 can be shaped and sized such that the tongue protector 120 can cover the entire width of the top side of the user's tongue. In some embodiments, the tongue protector 120 can be shaped and sized such that the tongue protector 120 can cover less than the entire width of the top side of the user's tongue.

In some embodiments, the tongue protector 120 can be elastic. For example, the tongue receptacle 122 can be sufficiently elastic such that the tongue receptacle 122 can have a smaller length and/or width when the tongue receptacle 122 is not engaged with a user's tongue than when the user's tongue is inserted within the tongue receptacle 122 and/or moved relative to the user's teeth while within the tongue receptacle 122. In some embodiments, the elasticity of the tongue protector 120 can vary within the tongue protector 120. For example, the tongue receptacle 122 can have a higher elasticity than the remainder of the tongue protector 120.

The tongue protector 120 can have any suitable flexural modulus. In some embodiments, the tongue protector 120 can have a low flexural modulus such that the tongue protector 120 is easily bendable. For example, the tongue protector 120 can have a flexural modulus sufficiently low such that the tongue protector 120 can be bendable by the user's tongue. In some embodiments, the tongue protector 120 can have a high flexural modulus such that the tongue protector 120 is rigid. For example, the tongue protector 120 can have a flexural modulus sufficiently high such that the tongue protector 120 is not bendable by a user's tongue. In some embodiments, the flexural modulus of the tongue protector 120 can vary within the tongue protector 120. For example, the tongue receptacle 122 can be more or less rigid than the remainder of the tongue protector 120.

The left tooth protector 130 and the right tooth protector 150 are configured to be secured to the teeth of the user. The left tooth protector 130 and the right tooth protector 150 can be configured to be secured to any suitable tooth or range of teeth. For example, in some embodiments, the left tooth protector 130 and the right tooth protector 150 can be shaped and sized such that the left tooth protector 130 and the right tooth protector 150 can be disposed over the left and right lower molars (e.g., the first and second premolars and first and second molars) and canines of the user, respectively. Said another way, the left tooth protector 130 and the right tooth protector 150 can be disposed over teeth on the left and right side of a user's mouth, respectively, leaving the user's incisors uncovered. In some embodiments, the left tooth protector 130 and the right tooth protector 150 can be shaped to be disposed over the user's range of teeth from the lower canine to the lower third molar (if the user has a lower third molar) on each side of the user's mouth. In some embodiments, the left tooth protector 130 and the right tooth protector 150 can only be disposed over the lower molars or the lower canines.

In some embodiments, the left tooth protector 130 and the right tooth protector 150 can be shaped to be disposed over the upper molars and canines of the user. In some embodiments, the left tooth protector 130 and the right tooth protectors 150 can each include two or more separate portions configured to engage a user's teeth. For example, a first portion of the left tooth protector 130 can be disposed over the lower canine and a second portion of the left tooth protector 130 can be disposed over the first molar and second molar, leaving the first premolar and the second premolar uncovered. In some embodiments, rather than including a distinct left tooth protector 130 and a distinct right tooth protector 150, one unitary teeth protector, including the left tooth protector 130 and the right tooth protector 105, can extend all the way around the user's lower or upper teeth, including over the user's lower or upper incisors.

The left tooth protector 130 and the right tooth protector 150 can be secured to the teeth of the user via any suitable means. In some embodiments, the left tooth protector 130 and the right tooth protector 150 are secured to the teeth of the user via a friction fit. In some embodiments, the left tooth protector 130 and the right tooth protector 150 can be configured to "snap" or "lock" into place over the teeth of the user. In some embodiments, the left tooth protector 130 and the right tooth protector 150 can engage each tooth along the entire height of each tooth (e.g., from the top of the tooth to the gum line). In some embodiments, the left tooth protector 130 and the right tooth protector 150 can engage only a portion of each tooth, such as the top half of each tooth. In some embodiments in which the left tooth protector 130 and the right tooth protector 150 are each disposed over a range of teeth, the left tooth protector 130 and the right tooth protector 150 can be secured to each tooth in the range. In some embodiments in which the left tooth protector 130 and the right tooth protector 150 are each disposed over a range of teeth, the left tooth protector 130 and the right tooth protector 150 can only be secured to the teeth on the edges of the range.

The left tooth protector 130 and the right tooth protector 150 can be formed as any suitable shape. In some embodiments, the left tooth protector 130 and the right tooth protector 150 can each have a rectangular shape such that the left tooth protector and the right tooth protector can be slid over the teeth of the user. In some embodiments, the left tooth protector 130 and right tooth protector 150 can each be shaped with a curve similar to the curve of the corresponding teeth of a user's mouth. In some embodiments, the left tooth protector 130 and the right tooth protector 150 can be shaped to conform to the shape of each individual tooth in the range over which the left tooth protector 130 and the right tooth protector 150 are to disposed. For example, the left tooth protector 130 and the right tooth protector 150 can be molded such that the left tooth protector 130 and the right tooth protector 150 are personalized for a particular user.

As described above, the left coupler 140 couples the left tooth protector 130 to the tongue protector 120, and the right coupler 160 couples the right tooth protector 150 to the tongue protector 120. Each of the left coupler 140 and the right coupler 160 can allow for limited movement of the tongue protector 120 relative to the left tooth protector 130 and the right tooth protector 150 (e.g., for speaking, eating, and/or drinking). For example, the left coupler 140 and the right coupler 160 can allow the user's tongue to move the tongue protector 120 within a mouth of the user and/or such that the user's tongue and the tongue protector 120 can extend beyond a user's incisors. In some embodiments, the left coupler 140 and the right coupler 160 can prevent the tongue protector 120, and therefore the user's tongue when within the tongue protector 120, from extending a particular distance from the left tooth protector 130 and the right tooth protector 150. In some embodiments, the left coupler 140 and the right coupler 160 can be configured such that the resistance to movement of the tongue protector 120 is increased as the tongue protector 120 is moved farther from the left tooth protector 130 and/or the right tooth protector 150. In some embodiments, the left coupler 140 and the right coupler 160 can be sufficiently rigid to not allow movement of the tongue protector 120 relative to the left tooth protector 130 and the right tooth protector 150. In some embodiments, the left coupler 140 and the right coupler 160 can each be a predetermined length such that the tongue protector 120 can only move a predetermined distance relative to the left tooth protector 130 and the right tooth protector 150.

In some embodiments, the left coupler 140 and the right coupler 160 can each provide an elastic support for the tongue protector 120 relative to the left tooth protector 130 and the right tooth protector 150. For example, the left coupler 140 and the right coupler 160 can each be formed of an elastomeric material. In some embodiments, the left coupler 140 and the right coupler 160 can include a spring made of, for example, metal. In some embodiments, the left coupler 140 and the right coupler 160 can be fixedly attached to the left tooth protector 130 and the right tooth protector 150, respectively, and/or to the tongue protector 120. In some embodiments, the left coupler 140 and the right coupler 160 can be releasably attached (e.g., via a magnetic attachment mechanism) to the left tooth protector 130 and the right tooth protector 150, respectively, and/or to the tongue protector 120.

Figure 16A:
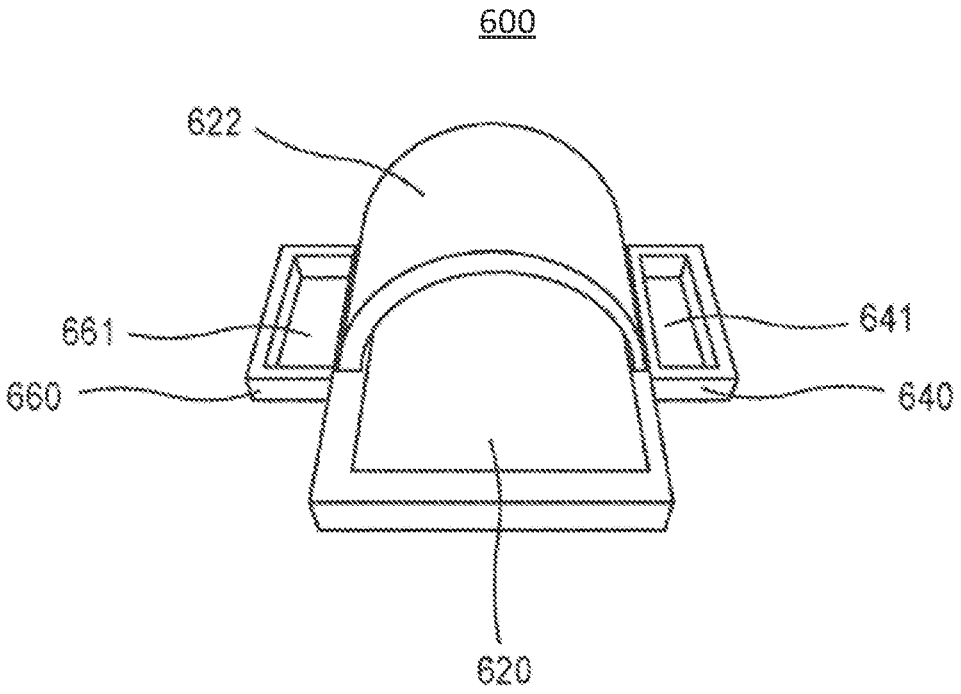
FIGS. 16A and 16B are front and rear bottom perspective views of an oral device according to an embodiment.
Figure 16B:
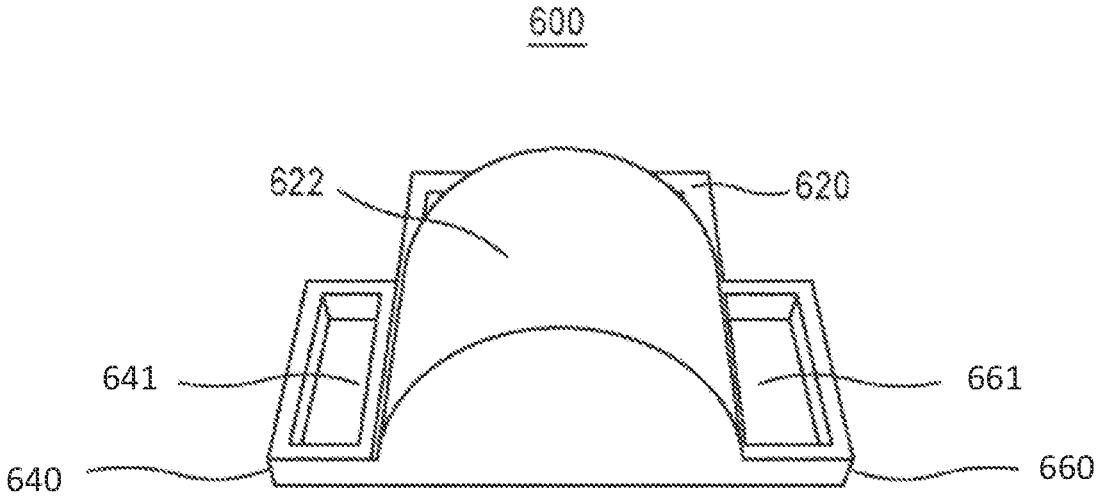

In some embodiments, as illustrated in the bottom perspective views of device 600 in FIGS. 16A and 16B, rather than including tooth protectors as shown with reference to device 100, the device 600 can be fashioned without tooth protectors such that, in use, the tops of the molars or teeth to which the device 600 is attached are uncovered. Specifically, the device 600 can be similar in structure and/or function to any of the devices described herein (e.g., the device 100) and can include tongue protector 620, tongue receptacle 622, and couplers 640 and 660. The couplers 640 and 660 can define holes or apertures 641 and 661, respectively, of any suitable shape, that allow the couplers to fit over and/or around the teeth of the user (e.g., a set of teeth including the back molars). In this embodiment the top of the teeth can remain exposed.

Figure 18:
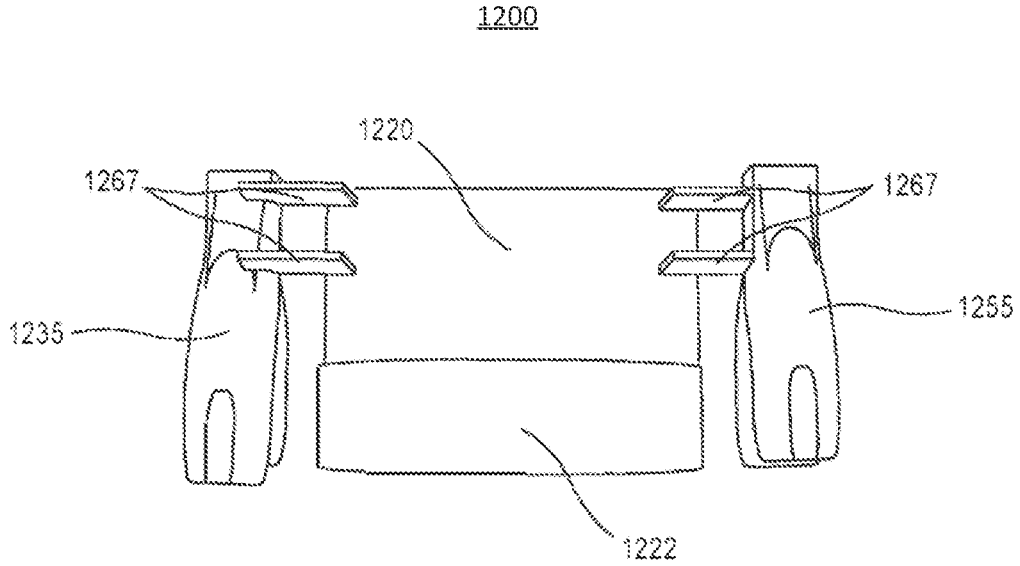
FIG. 18 is a bottom view of an oral device according to an embodiment.
Figure 19:
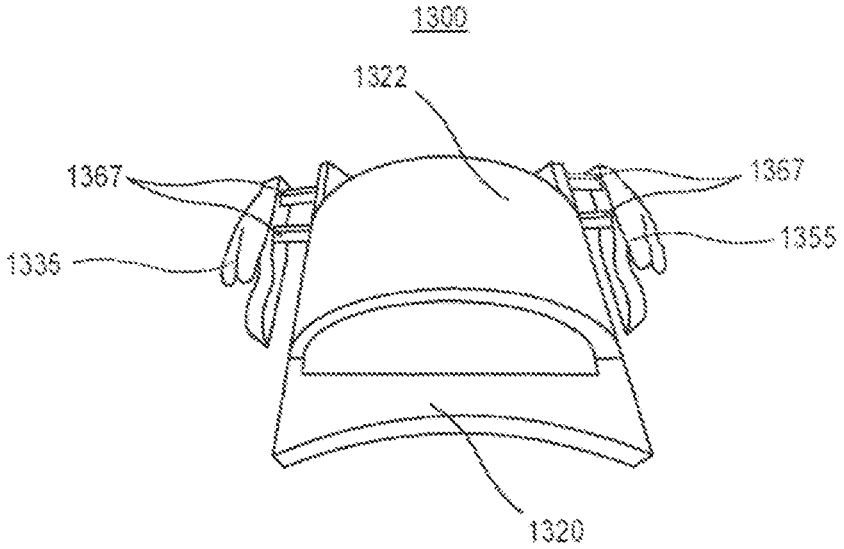
FIG. 19 is a perspective bottom view of an embodiment of an oral device according to an embodiment.

In some embodiments, instead of couplers fitting over the back molars, a device can include two or more thin filaments, attached to the tongue protector, that can fit between teeth of the user (e.g. the molars or other top or bottom teeth). For example, FIG. 18 is a top view of a device 1200 and FIG. 19 is a top perspective view of a device 1300. The device 1200 and the device 1300 can be similar in structure and/or function to any of the devices described herein. Specifically, the device 1200 includes filaments 1267 and the device 1300 includes filaments 1367. As shown in FIG. 18, the filaments 1267 can couple a tongue protector 1220 including a tongue receptacle 1222 to the anchors 1235 and 1255 (also referred to herein as "attachments"). As shown in FIG. 19, the filaments 1367 can couple a tongue protector 1320 including a tongue receptacle 1322 to the anchors 1335 and 1355 (also referred to herein as "attachments"). The filaments 1267 and 1367 can be thin enough to slide between the teeth. The filaments 1267 and 1367 can be made of elastomers or polymers such as nylon or Teflon (polytetrafluoroethylene). The filaments 1267 and 1367 can include a coating agent (waxed or unwaxed) that allows for easy fit between the teeth. The filaments 1267 and 1367 can include a flavor profile, similar to how the tongue protector can contain a flavoring agent as described herein in some embodiments.

Although FIGS. 18 and 19 show two filaments 1267 and 1367 coupled to each side of the tongue protector 1220 and 1320, respectively, in some embodiments the devices 1200 and/or 1300 can include any suitable number of filaments, such as, for example, one, three, or four. In some embodiments, rather than including anchors, one or more filaments can couple the devices 1200 and/or 1300 to one or more teeth via wrapping the one or more filaments around one or more teeth, creating an aperture within which the one or more teeth can be secured.

Figure 20:
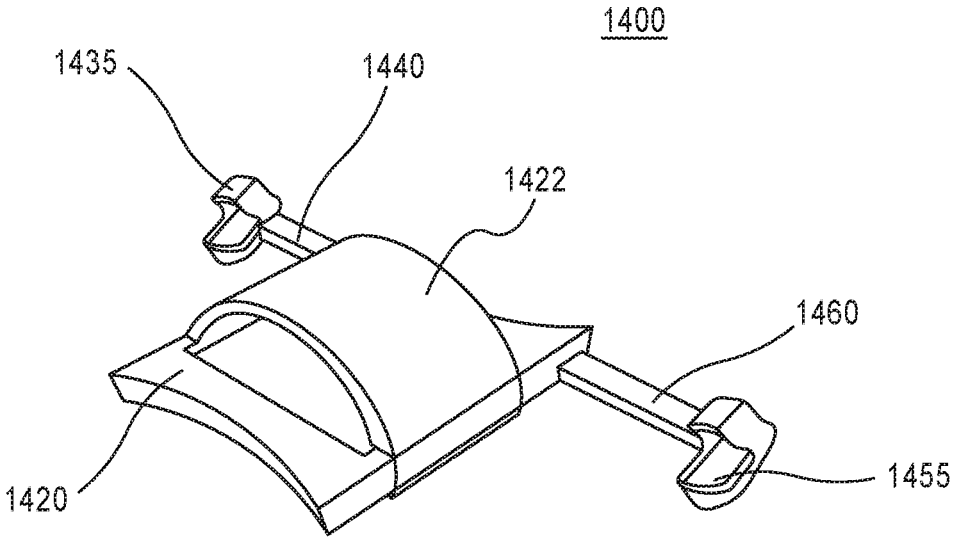
FIG. 20 is a perspective bottom view of an oral device according to an embodiment.
Figure 21:
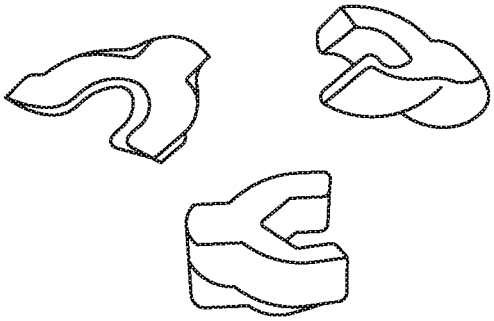
FIG. 21 shown perspective views of exemplary shapes of sockets or anchoring attachments usable with the oral device of FIG. 20.

As described above, in some embodiments, the ends of the two thin filaments 1267 and 1367 can be attached the tongue protector to anchors and/or weighted anchors (also referred to as "attachments"), such as attachments 1235 and 1255 shown in FIG. 18 or attachments 1335 and 1355 shown in FIG. 19. The attachments may be in the form of sockets. For example, in some embodiments, the attachments can include an upper portion and a lower portion, the upper portion and the lower portion extending away from an attachment location between the attachments and the filaments. The attachments can be configured to create tension in the filaments like 1267 while attached to the tongue protector, anchoring the tongue protector and filaments in place between the teeth. In some embodiments, anchors or attachments, such as the anchors shown in FIGS. 18 and 19, can also be used in conjunction with couplers. For example, FIG. 20 shows a device 1400 which can be similar in structure and/or function to any of the devices described herein. The device 1400 can include a tongue protector 1420 having a tongue receptacle 1422, attachments 1435 and 1455, and couplers 1440 and 1460. The couplers 1440 and 1460 can couple the tongue protector 1420 to the attachments 1435 and 1455, respectively. The attachments 1435 and 1455 can assume any suitable shape such that they provide anchoring properties. Some exemplary shapes are illustrated in FIG. 21. The attachments can be made to be weighted such that they allow for the tongue protector to be secure and create tension in the filaments or couplers attached to the tongue protector. The attachments can serve as anchors or supports of the tongue protector. The attachments, when in use, can lie between the cheek or inner jaw and the outside of the teeth. When the user bites down, the tongue protector will house the tongue, the filaments will be disposed between the teeth (for example, molars), so as not to impede the bite of the user, and the sockets will be on the outside of the teeth and between the cheek and the jaw. The attachments position between the cheeks and the inner jaw can also protect the inner cheek and the inner jaw from oral trauma or injury due to teeth clenching during a seizure. In some embodiments, as shown in FIG. 21, the attachments can be substantially U-shaped or V-shaped such that an upper portion of each attachment engages, for example, an upper portion of a user's cheek, and a lower portion of each attachment engages, for example, a lower portion of a user's cheek.

In some embodiments, the device configuration ensures that the tongue protector is secure during spasmodic or jerking movements that may occur during convulsive seizures. It also allows the tongue protector to stay in place while the teeth and tongue are moving during a seizure. It also allows the mouth to open and close, and the tongue to move, without the device becoming dislodged. Whereas in some embodiments the tongue protector receives the tip of the tongue, in other embodiments, such as devices 1300 and 1400 illustrated in FIGS. 19 and 20, for example, the tongue receptacle of the tongue protector may not enclose the tip of the tongue but rather rest on top of the tongue covering a portion of the tongue but not covering the tip of the tongue or the portion of the tongue underneath the tip.

In some embodiments, as indicated in the schematic in FIG. 1, the left coupler 140, the right coupler 160, and/or the tongue protector 120 can include an electromechanical component (not shown). The electromechanical component can cause, for example, vibration of the tongue protector 120. The electromechanical component can also provide mobility and support for the tongue protector 120 (and the user's tongue when engaged with the tongue protector 120). Thus, users who have tongue paresthesia or tongue weakness, such as epileptic or stroke patients, can use the device 100 to rehabilitate tongue strength.

In some embodiments, the electromechanical component can include a motor controlled by a printed circuit board (PCB) and powered by a power source. A vibrating element, such as, for example, a small weight, can be attached to the motor. The electromechanical component can also include a housing in which the motor, power source, vibrating element, and/or PCB can be disposed. The power source can be, for example, a small, rechargeable battery. The battery can be selected to optimize space efficiency and power. The PCB can control the motor to provide various patterns and multiple speeds of vibration. In some embodiments, a single button can be used to perform multiple functions (e.g., turn the motor on/off and select one of the various patterns and multiple speeds of vibration). In some embodiments, the PCB can include two or more controls to induce specific changes to the length and resistance of the wires and/or circuit of the PCB to adjust the pattern and speed of vibration of the vibrating element. The housing can be relatively thin and can be formed of, for example, plastic or another hard material.

In some embodiments, the electromechanical component, or a portion of the electromechanical component, can be encapsulated by the material (e.g., polymer) of one of the couplers 140, 160 and/or the tongue protector 120. Although only one electromechanical component has been described, in some embodiments each of the left coupler 140 and the right coupler 160 can be associated with a separate electromechanical component.

In some embodiments, the oral device can contain a sensor that enables the device to sense saliva production and/or force of bite during seizures. This sensor can be configured to be housed inside the tongue protector, inside the couplers, and/or inside the sockets. The wearable sensor automatically collects data that is used to detect seizures or movement disorders or neurologic disorders characterized by hypersalivation, excessive drooling, and/or teeth clenching (biting) in association with a probable seizure or convulsive activity. This wearable sensor allows the device to be used to track biometric data and thus can be used as not only a preventative intervention but also as a diagnostic tool for tracking or diagnosing seizures based on this symptomatology. In some embodiments, such a device could be used in the clinic as a diagnostic and preventative intervention. In similar or some other embodiments, such a device could also be used in an outpatient setting and/or as a consumer technology. In some embodiments, the device can be fashioned to provide critical support especially during nocturnal seizures when a person may not be aware that they are experiencing a seizure, and thus evidence of these symptoms could provide information about whether the person experienced a seizure, and for how long, and how severe an episode based on the force of bite measured using the sensor on the tongue protector. This will allow patients to track their seizure activity while wearing the device for protection, and/or be used as means for refining or improving treatment plans for symptom management.

In use, the oral device 100 can prevent the damage from teeth to teeth and/or teeth to tongue impact that can occur during biting or chewing (e.g., during a seizure). For example, during a seizure, damage to the teeth and/or lateral lacerations and/or other injuries to the tongue can be caused by the molars and/or canines. Due to the surface area ratio, the lower molars (i.e. molars and premolars) and canines can experience the most impact during the chewing motion. Additionally, lacerations and/or other injuries to the tip of the tongue can be caused by the incisors. The oral device 100 can prevent damage and injury to the teeth and tongue via the dissipation and mitigation of the force of impact between, for example, the top and bottom molars and canines and between the teeth and the tongue.

Specifically, the left tooth protector 130 and the right tooth protector 150 can have both a device-securing function and a teeth-protecting function. The left tooth protector 130 and the right tooth protector 150 can have a device-securing function in that the oral device 100 can be maintained in position within the mouth of the user via the left tooth protector 130 and the right tooth protector 150 being secured and maintained on the teeth of the user. As a result of the left tooth protector 130 and the right tooth protector 150 being secured and maintained on the teeth of the user, the tongue protector 120 can be held in position and/or can have limited movement relative to the teeth of the user via the left coupler 140 and the right coupler 160.

Second, the left tooth protector 130 and the right tooth protector 150 can have a teeth-protecting function in that the left tooth protector 130 and the right tooth protector 150 can dissipate and mitigate the force of impact between, for example, the top and bottom molars and canines. For example, in some embodiments, the material forming the portion of each of the tooth protectors 130, 150 disposed over the top surface of the lower teeth can be sufficiently thick to absorb the force of the top teeth impacting the lower teeth such that the top teeth and the lower teeth are not damaged. Additionally, in some embodiments, if the lateral portions of the tongue are disposed between the tooth protectors 130, 150 and the upper teeth, the tooth protectors 130, 150 can prevent the lateral portions of the tongue from being damaged due to the ability of the tooth protectors 130, 150 to absorb some of the force resultant from the upper teeth impacting the tongue. In some embodiments, the tooth protectors 130, 150 can be shaped and sized such that lateral portions of the tongue are prevented from being disposed in the space between the upper teeth and the lower teeth.

The tongue protector 120 can prevent lacerations and/or other injuries to the tip of the tongue (e.g., caused by the incisors). In some embodiments, the tongue protector 120 can also prevent lateral lacerations and/or other injuries to the lateral portions of the tongue caused by the canines and/or molars by protecting the tongue from direct contact with the teeth. The tongue protector 120 can serve as a barrier between uncovered teeth and the tongue of the user. In use, when the user's tongue is placed inside the tongue receptacle 122 of the tongue protector 120, the tongue protector 120 can protect the bottom of the tip of the tongue, the top of the tip of the tongue, and a portion of the remainder of the tongue. In some embodiments, the tongue protector 120 can cover the bottom of the tongue and the tip of the top of the tongue to the middle of the top of the tongue.

The tongue protector 120, the tooth protectors 130, 150, and/or the couplers 140, 160 can be made of any suitable material(s). The material(s) can be selected based on considerations including: a) withstanding the force with which chewing and biting may occur during seizures; and b) efficacy in minimizing hypersalivation.

With respect to withstanding force, the material selected for the tongue protector 120 can have a compressive strength sufficient to resist the compression caused by the teeth of the user on the tongue protector 120. The material selected for the tongue protector 120 can have a shear strength sufficient to resist piercing by the teeth through the material of the tongue protector 120, thus preventing injury to the tongue. Additionally, the material of the tongue protector 120 can be sufficiently elastic to allow lateral and vertical mobility of the tongue protector 120 when engaged with a user's tongue. Additionally, the material of the tongue protector 120 can be sufficiently elastic to allow the mouth of the user to open and close as needed. The elasticity of the tongue protector 120 can also assist in reducing teeth clenching, which can cause muscles to tighten. In some embodiments, the elasticity of the tongue protector 120 can provide mobility support for the tongue and enable users with tongue weakness, such as stroke patients, to rehabilitate tongue strength.

The tooth protectors 130, 150 can be formed of a material with a high compressive strength to resist compression by the teeth during a biting or chewing movement. Additionally, in some embodiments, the tooth protectors 130, 150 can be formed of a material with low elasticity such that the tooth protectors 130, 150 can snap lock into place over the teeth of the user. In some embodiments, the tooth protectors 130, 150 can be formed of a material resulting in sufficient surface friction such that the tooth protectors 130, 150 can remain secured to the teeth via a friction fit.

In some embodiments, the left coupler 140 and the right coupler 160 can be formed of the same material as the tongue protector 120 and/or the tooth protectors 130, 150. In some embodiments, the oral device 100 can be formed as a one piece, unitary structure. For example, the oral device 100 can be molded. The thicknesses of each portion of the oral device 100 can be selected based on the desired characteristics of that portion. For example, the left coupler 140 and the right coupler 160 can have a particular thickness corresponding to a particular elasticity. Similarly, the tongue receptacle 122 can have a particular thickness that is the same or different from the thickness of the left coupler 140 and the right coupler 160 such that the tongue receptacle 122 has a particular elasticity. Thus, the degree of movement of the tongue relative to the left tooth protector 130 and the right tooth protector 150 can be limited as desired by adjusting the thicknesses of each of the components of the oral device 100.

In some embodiments, the thickness of the tongue protector 120 can be sufficiently thin to minimize the space between the front teeth and the tip of the tongue such that the user can communicate verbally (e.g., with a minor lisp) and such that the oral device 100 is comfortable for the user. The tongue protector 120 must also be of sufficient durability (e.g., thickness, shear strength, and/or compressive strength) to effectively protect the tongue from injury by the user's teeth.

In some embodiments, the dimensions of the oral device 100 can be selected such that the oral device 100 can conform to the mouth size of an adult. In some embodiments, the dimensions of the oral device 100 can be selected such that the oral device 100 can conform to the mouth size of a child. For example, the dimensions of the tongue protector can be selected such that the tongue protector 120 can conform to the tongue size of an adult or a child.

As described above, the material(s) of the oral device 100 can be selected based on the material(s) efficacy in minimizing hypersalivation. A person experiencing a seizure, for example, often has difficulty swallowing. This can cause saliva to be retained in the mouth, which can lead to choking. Thus, the oral device 100 or a portion of the oral device 100 can be made of a polymer having both sufficient durability to withstand a chewing or biting force and absorbent properties to prevent the accumulation of saliva and foaming at the mouth. For example, the oral device 100 or a portion of the oral device 100 can include superabsorbent polymers (SAPs) and/or synthetic hydrogels engineered to absorb and retain large amounts of a liquid relative to their own mass. In some embodiments, the oral device 100 or a portion of the oral device 100 can include a non-toxic, sponge-like or foamed polymer having super absorbent properties. The use of an oral device 100 having such material properties will allow a user of the oral protector to maintain a comfortable position during a seizure. While it is commonly advised by healthcare professionals to turn a patient on his/her side to allow saliva to drain from the mouth, the oral device 100 will allow patients who experience a seizure to maintain any comfortable position, such as sitting upright, lying supine, or lying on either side, without the concern of choking or foaming at the mouth.

In some embodiments, the shape of the tongue protector 120 can be selected to yield the highest probability of limited salivation, protection and non-injury. For example, as described above, the shape of the tongue protector 120 can be substantially U-shaped, similar to that of the user's tongue, and the tooth protectors 130 and 150 holding the device in place on the teeth can be shaped akin to a rectangle.

In some embodiments, the tongue protector 120 can optionally define one or more perforations or apertures 128. The one or more apertures 128 can strengthen the tongue protector 120 due to their tendency to oscillate under impact. Additionally, the one or more apertures 128 can allow airflow through the tongue protector 120 to the tongue and assist in reducing the buildup of saliva which may occur as a result of excessive salivation (e.g., during seizures). The one or more apertures 128 can also facilitate the administration of liquids to a user by mouth using a straw or other hydration device, such as, for example, in a hospital or outpatient clinic. More specifically, the one or more apertures will assist in delivering liquid directly to the tongue of the patient without needing to remove the device.

Figure 17A:
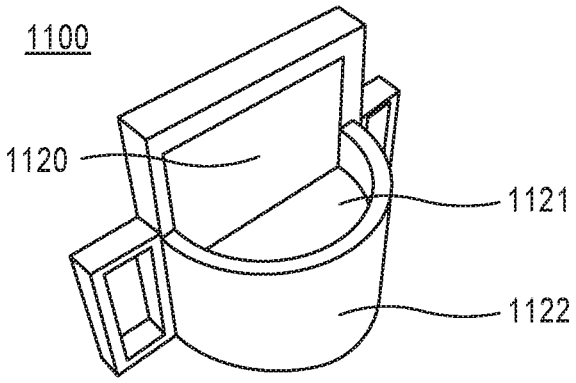
FIGS. 17A and 17B are perspective views of an oral device showing a space for insertion of an absorbent material, according to an embodiment.
Figure 17B:
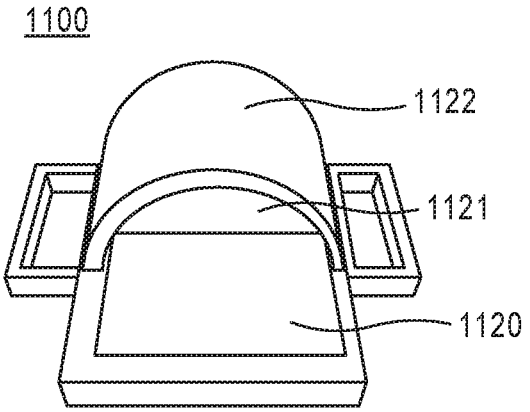
Figure 17C:
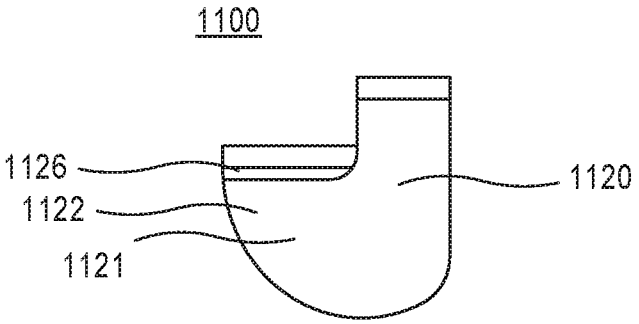
FIG. 17C is a schematic illustration of the placement of an absorbent pad in the oral device of FIGS. 17A and 17B.

In some embodiments, the oral device can include a space within and/or under the tongue receptacle configured to receive an absorbent pad. For example, device 1100 shown in FIGS. 17A and 17B includes a space 1121 within and/or under a tongue receptacle 1122 of a tongue protector 1120 between the outer skins of the polymer. The device 1100 can be similar in structure and/or function to any of the devices described herein. The space 1121 is also shown schematically in FIG. 17C. The space 1121 can accommodate a removable absorbent pad 1126 (also referred to herein as a "removable absorbent component"). The space 1121 can be located under the tongue when the device 1100 is in use, as most of the salivary glands are located on the underside of the tongue. In some embodiments, the removable absorbent component 1126 can be releasably secured to the tongue protector 1120 with a mechanical interlock or other suitable mechanism. In some embodiments a polymer that withstands the compression from biting and an absorbent polymer can be molded with the removable absorbent component 1126.

Some patients have expressed an unpleasant taste occurring as a consequence of having a seizure. As such, a flavoring agent can be embedded in the material of the tongue protector 120. In some embodiments, designs can be printed on the tongue protector 120 for aesthetic purposes. For example, designs on the tongue protector 120 can make the oral device 100 more child-friendly, reduce anxiety, and improve patient compliance. In some embodiments, the material of the oral device 100 can have shock absorption properties. In some embodiments, the material of the oral device 100 can have anti-microbial properties. In some embodiments, the oral device 100 can be disposable after each use. In some embodiments, the oral device 100 can be made of a durable material such that the oral device can be reusable for a period of time, such as, for example, one month or several months.

In addition to a flavoring profile, in some embodiments a drug can be embedded into the polymer of the tongue protector. The oral device could then act as a method of drug delivery. For example, a drug like Zofran or a muscle relaxant, could be embedded into the polymer of the tongue protector. Once the user inserts the device into their mouth, the medicine would disintegrate into the user's mouth while the seizure or neurologic episode is in progress. This medicine would relax the user, while the device protects the user from oral injury and drooling.

The oral device 100 can be worn for any suitable duration of time. In some circumstances, patients who have been diagnosed with a neurological condition that causes seizures can consult with their physician and identify possible triggers or warning sign factors before seizure onset. Such people, when experiencing a trigger or an aura, can insert the oral device 100 into his/her mouth before a seizure begins. For users who do not experience warning signs prior to seizure onset, or users with conditions resulting in continuous uncontrollable movements that may result in tongue injury, the device can be worn at all times and removed only for limited periods, such as, for example, for eating. Due to the structure of the oral device 100, the user can position the oral device 100 quickly and easily without requiring a fitting by a specialist or teeth impressions taken in advance. Said another way, the oral device 100 can be an off-the-shelf device that can be configured to engage with a number of potential user's mouths. In some embodiments, the oral device 100 can be retailed over the counter. In some embodiments, the oral device 100 can be considered durable medical equipment and made available to patients by way of a medical prescription. In some embodiments, the oral device 100 can be available to EMT staff, in hospitals, and/or in clinics for a patient who is experiencing an ongoing seizure and/or while a patient who had a seizure is being evaluated further. In some embodiments, the oral device 100 can be administered to stroke patients or patients requiring oral motor therapy or speech therapy to supplant tongue rehabilitation and improve tongue strength lost due to tongue paresthesia or numbness.

Figure 2:
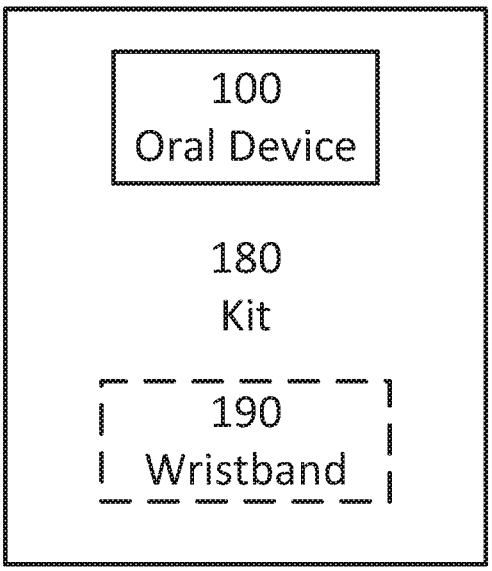
FIG. 2 is a schematic illustration of the oral device of FIG. 1 as part of a kit, according to an embodiment.

As shown in FIG. 2, in some embodiments the oral device 100 can be disposed inside a kit 180. The kit 180 can include a case or container that can be worn around a neck of the user for quick accessibility. The kit 180 can also include a wristband 190. The wristband 190 can include a label that informs a reader that the user/wearer has the oral device 190. Thus, other people and/or healthcare professionals can be made aware that the user has the oral device 100 in the event that the user feels that a seizure will occur or the user starts to have a seizure.

The kit can house the oral device when not in use. In some embodiments of the kit, the kit can contain a button that is powered by a battery or other source of electric power. The button can be located on the kit or as a separate component attachable to the kit. This button can be pressed by the user when they experience an aura or physiological/sensory change to their body or environment that alerts an impending seizure, and precedes the user opening their kit to remove the oral device and administer it into their mouth prior to seizure onset. This button can be connected via, for example, Bluetooth to an app on a smartphone or similar device that keeps track of how many times the button is pressed and in what intervals of time. This "smart kit" can be useable during a pilot study or clinical trial in order to interpret how well patients notice or track auras. The data gathered from similar kits can also be mined and used by physicians to collect patient compliance data regarding how often the oral device is used.

Figure 3:
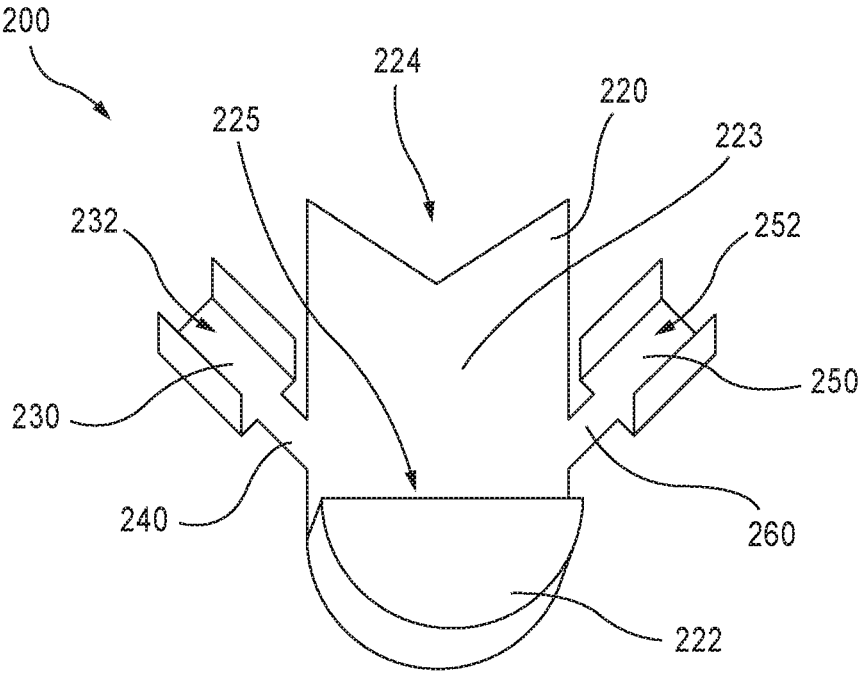
FIGS. 3-5 are top and bottom perspective views of an oral device according to another embodiment.
Figure 4:
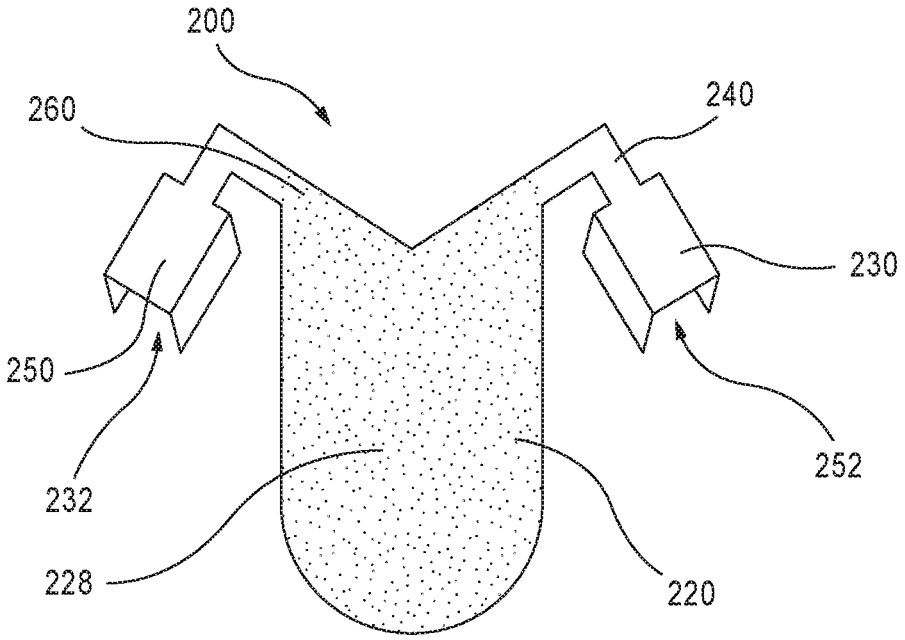
Figure 5:
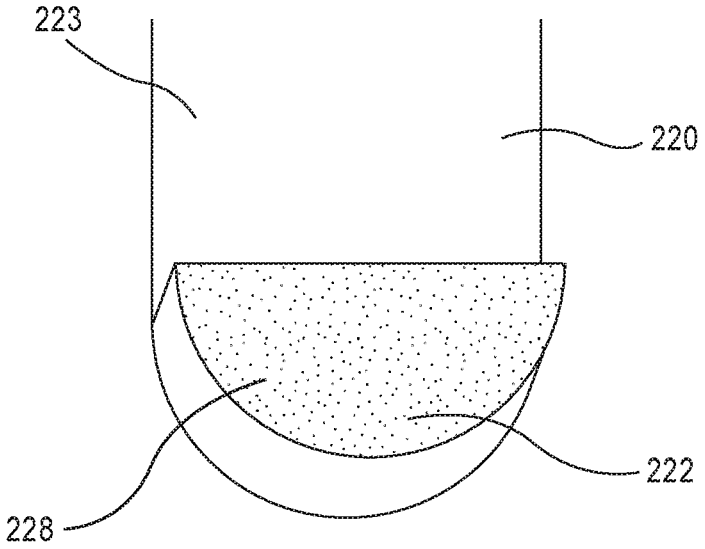

FIGS. 3-5 are bottom and top perspective views of an oral device 200. As shown in FIG. 3, which is a bottom perspective view of the oral device 200, the oral device 200 includes a tongue protector 220, a left tooth protector 230, and a right tooth protector 250. The left tooth protector 230 and the right tooth protector 250 are coupled to the tongue protector 220 via a left coupler 240 and a right coupler 260, respectively.

The oral device 200 can be the same or similar in structure and/or function to any of the oral devices described herein, such as, for example, oral device 100. For example, the tongue protector 220 can include a tongue receptacle 222. The tongue receptacle 222 can define an interior space 225 in which the tip of a user's tongue can be disposed during use. As shown in FIGS. 3-5, the tongue protector 220 can be shaped such that the tongue protector 220 includes a rounded front portion (e.g., formed by the tongue receptacle 222) intended for engagement with the tip of the user's tongue and a back portion 223 intended for engagement with the top side of the user's tongue. The back portion also includes a rear cut out 224 having a triangular shape. Although the back portion 223 is shown as having the shape shown in FIGS. 3 and 4, the back portion 223 can have any suitable shape, such as, for example, a rectangular shape.

The tongue protector 220 and the tongue receptacle 222 can have any suitable length and width. For example, in some embodiments, the tongue protector 220 can be shaped and sized such that the tongue protector 220 can enclose the bottom side of the user's tongue and half of the length of the top side of the user's tongue. In some embodiments, the tongue protector 220 can be shaped and sized such that the tongue receptacle 222 can enclose only a front portion of the user's tongue such that less than the entire bottom side of the user's tongue is enclosed and the tongue protector 220 can extend over less than half of the length of the top side of the user's tongue. In some embodiments, the tongue protector 220 can be shaped and sized such that the tongue receptacle 222 can enclose only a front portion of the user's tongue such that less than the entire bottom side of the user's tongue is enclosed and the tongue protector 220 can extend over half or more than half of the length of the top side of the user's tongue.

With respect to the width of the tongue protector 220, in some embodiments the tongue protector 220 can be shaped and sized such that the tongue protector 220 can cover the entire width of the top side of the user's tongue. In some embodiments, the tongue protector 220 can be shaped and sized such that the tongue protector 220 can cover less than the entire width of the top side of the user's tongue.

In some embodiments, the tongue protector 220 can be elastic. For example, the tongue receptacle 222 can be sufficiently elastic such that the tongue receptacle 222 can have a smaller length and/or width when the tongue receptacle 222 is not engaged with a user's tongue than when the user's tongue is inserted within the tongue receptacle 222 and/or moved relative to the user's teeth while within the tongue receptacle 222. In some embodiments, the elasticity of the tongue protector 220 can vary within the tongue protector 220. For example, the tongue receptacle 222 can have a higher elasticity than the remainder of the tongue protector 220.

The tongue protector 220 can have any suitable flexural modulus. In some embodiments, the tongue protector 220 can have a low flexural modulus such that the tongue protector 220 is easily bendable. For example, the tongue protector 220 can have a flexural modulus sufficiently low such that the tongue protector 220 can be bendable by the user's tongue. In some embodiments, the tongue protector 220 can have a high flexural modulus such that the tongue protector 220 is rigid. For example, the tongue protector 220 can have a flexural modulus sufficiently high such that the tongue protector 220 is not bendable by a user's tongue. In some embodiments, the flexural modulus of the tongue protector 220 can vary within the tongue protector 220. For example, the tongue receptacle 222 can be more or less rigid than the remainder of the tongue protector 220.

The left tooth protector 230 and the right tooth protector 250 are configured to be secured to the teeth of the user. As shown in FIG. 3, the left tooth protector 230 and the right tooth protector 250 can each have a rectangular shape and can each define a tooth-receiving portion 232, 252 such that the left tooth protector and the right tooth protector can be slid over the teeth of the user. The left tooth protector 230 and the right tooth protector 250 can be configured to be secured to any suitable tooth or range of teeth. For example, in some embodiments, the left tooth protector 230 and the right tooth protector 250 can be shaped and sized such that the left tooth protector 230 and the right tooth protector 250 can be disposed over the left and right lower molars (e.g., the first and second premolars and first and second molars) and canines of the user, respectively. Said another way, the left tooth protector 230 and the right tooth protector 250 can be disposed over teeth on the left and right side of a user's mouth, respectively, leaving the user's incisors uncovered. In some embodiments, the left tooth protector 230 and the right tooth protector 250 can be shaped to be disposed over the user's range of teeth from the lower canine to the lower third molar (if the user has a lower third molar) on each side of the user's mouth. In some embodiments, the left tooth protector 230 and the right tooth protector 250 can only be disposed over the lower molars or the lower canines. Although the left tooth protector 230 and the right tooth protector 250 are shown with the tooth-receiving portions 232, 252 of the tooth protectors 230, 250 facing down, in some embodiments the tooth protectors 230, 250 can be arranged such that the tooth-receiving portions 232, 252 are facing upward such that the tooth protectors 230, 250 can be disposed over the upper molars and canines of the user.

As described above, the left coupler 240 couples the left tooth protector 230 to the tongue protector 220, and the right coupler 260 couples the right tooth protector 250 to the tongue protector 220. Each of the left coupler 240 and the right coupler 260 can allow for limited movement of the tongue protector 220 relative to the left tooth protector 230 and the right tooth protector 250 (e.g., for speaking, eating, and/or drinking). For example, the left coupler 240 and the right coupler 260 can allow the user's tongue to move the tongue protector 220 within a mouth of the user and/or such that the user's tongue and the tongue protector 220 can extend beyond a user's incisors. In some embodiments, the left coupler 240 and the right coupler 260 can prevent the tongue protector 220, and therefore the user's tongue when within the tongue protector 220, from extending a particular distance from the left tooth protector 230 and the right tooth protector 250. In some embodiments, the left coupler 240 and the right coupler 260 can be configured such that the resistance to movement of the tongue protector 220 is increased as the tongue protector 220 is moved farther from the left tooth protector 230 and/or the right tooth protector 250. In some embodiments, the left coupler 240 and the right coupler 260 can be sufficiently rigid to not allow movement of the tongue protector 220 relative to the left tooth protector 230 and the right tooth protector 250. In some embodiments, the left coupler 240 and the right coupler 260 can each be a predetermined length such that the tongue protector 220 can only move a predetermined distance relative to the left tooth protector 230 and the right tooth protector 250.

As shown in FIG. 4, which is a top view of the oral device 200, the left coupler 240 and the right coupler 260 can each provide an elastic support for the tongue protector 220 relative to the left tooth protector 230 and the right tooth protector 250. For example, the left coupler 240 and the right coupler 260 can each be formed of an elastomeric material. The left coupler 240 and the right coupler 260 can be fixedly attached to the left tooth protector 230 and the right tooth protector 250, respectively, and to the tongue protector 220.

As shown in FIGS. 4 and 5, FIG. 5 being a top view of a portion of the tongue protector 220, the tongue protector 220 can define a number of apertures 228. The apertures 228 can be located on both the tongue receptacle 222 and the back portion 223. The apertures 228 can strengthen the tongue protector 220 due to their tendency to oscillate under impact. Additionally, the apertures 228 can allow airflow through the tongue protector 220 to the tongue and assist in reducing the buildup of saliva which may occur as a result of excessive salivation (e.g., during seizures). The apertures 228 can also facilitate the administration of liquids to a user by mouth using a straw or other hydration device, such as, for example, in a hospital or outpatient clinic. More specifically, the apertures 228 will assist in delivering liquid directly to the tongue of the patient without needing to remove the device.

Figure 6:
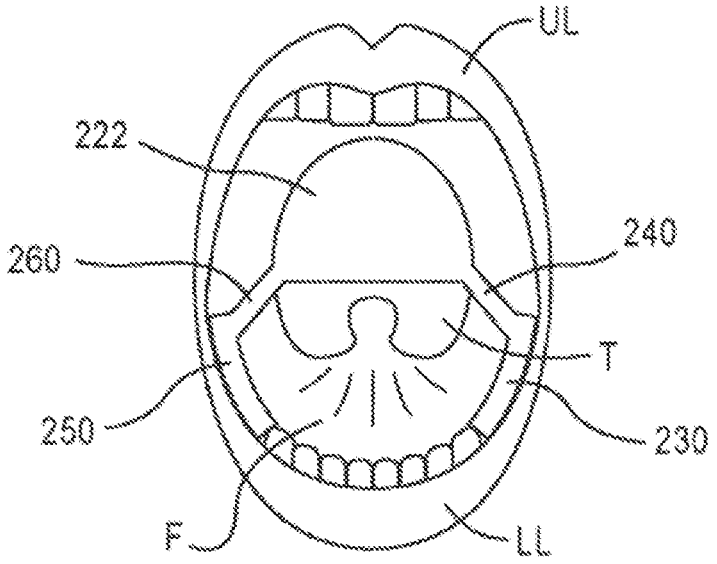
FIG. 6 is a front perspective view of the oral device of FIGS. 2 and 3 in place in the mouth of a user.

In use, the oral device 200 can prevent the damage from teeth to teeth and/or teeth to tongue impact that can occur during biting or chewing (e.g., during a seizure). For example, as described above with reference to oral device 100, during a seizure, damage to the teeth and/or lateral lacerations and/or other injuries to the tongue can be caused by the molars and/or canines. Due to the surface area ratio, the lower molars and canines can experience the most impact during the chewing motion. Additionally, lacerations and/or other injuries to the tip of the tongue can be caused by the incisors. The oral device 200 can prevent damage and injury to the teeth and tongue via the dissipation and mitigation of the force of impact between, for example, the top and bottom molars and canines and between the teeth and the tongue. As shown in FIG. 6, in some embodiments, the oral device 200 can be disposed within the mouth of a user having an upper lip UL and a lower lip LL such that the left tooth protector 230 is coupled to a number of the lower left teeth of the user, the right tooth protector 250 is coupled to a number of the lower right teeth of the user, and the tongue T of the user is disposed within the tongue receptacle 222. As shown in FIG. 6, in some embodiments, the tongue T of the user can be raised relative to the floor F of the mouth without the right tooth protector 250 or the left tooth protector 230 decoupling from the lower teeth of the user.

As described above with reference to the oral device 100, the tongue protector 220, the tooth protectors 230, 250, and/or the couplers 240, 260 can be made of any suitable material(s). The material(s) can be selected based on considerations including: a) withstanding the force with which chewing and biting may occur during seizures; and b) efficacy in minimizing hypersalivation.

Figure 7:
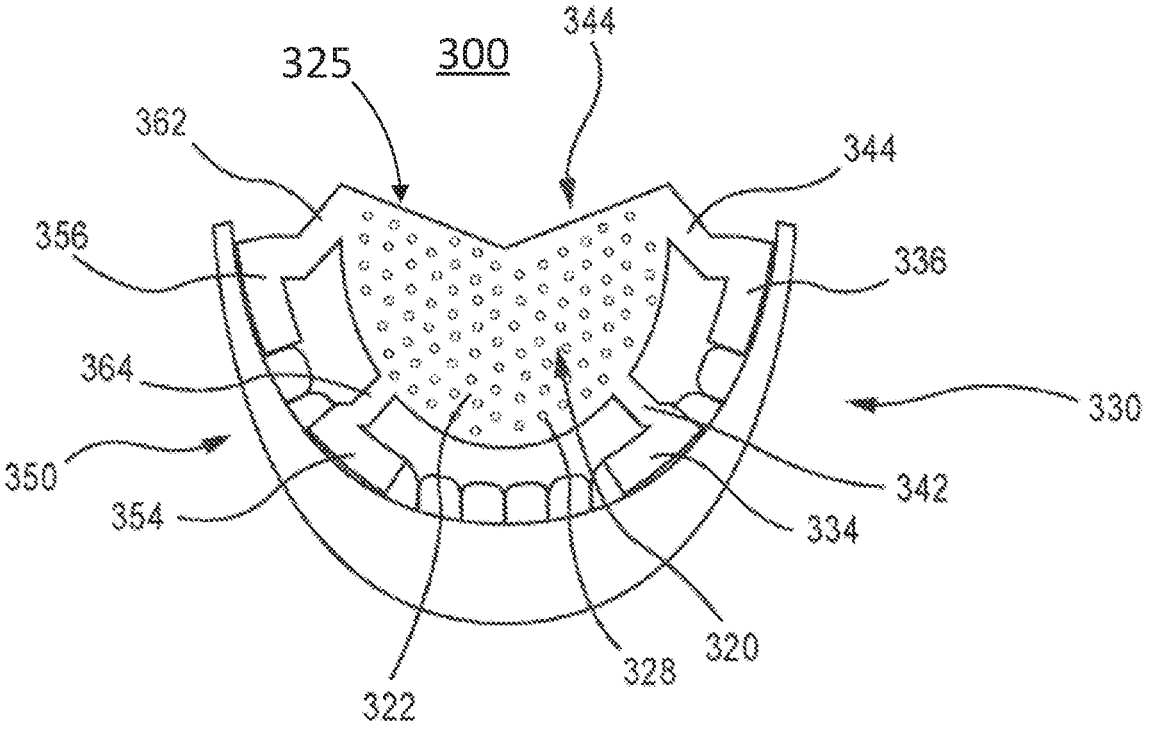
FIG. 7 is a top view of an oral device according to another embodiment disposed on the lower jaw of a user.

FIG. 7 is a top view of an oral device 300 disposed on the lower jaw of a user. The oral device 300 can be the similar in structure and/or function to any of the oral devices described herein, such as oral device 100 and/or oral device 200. For example, the oral device 300 can include a tongue protector 320, a left tooth protector 330, and a right tooth protector 350. The tongue protector 320 can include a tongue receptacle 322. The tongue receptacle 322 can define an interior space 325. Additionally, the tongue protector 320 can define a number of perforations or apertures 328.

In the embodiment shown in FIG. 7, the left tooth protector 330 and the right tooth protector 350 can each include two separate portions configured to engage a user's teeth. The left tooth protector 330 includes a left front tooth protector 334 and a left back tooth protector 336. The right tooth protector 350 includes a right front tooth protector 354 and a right back tooth protector 356. Similarly, each of the front and back tooth protectors on each side of the oral device 300 can be coupled to the tongue protector 320 via a separate coupler. As shown in FIG. 7, the left front tooth protector 334 and the left back tooth protectors 336 are coupled to the tongue protector 320 via a left front coupler 342 and a left back coupler 344, respectively. The right front tooth protector 354 and a right back tooth protector 356 are coupled to the tongue protector 320 via a right front coupler 364 and a right back coupler 362, respectively.

Figure 8:
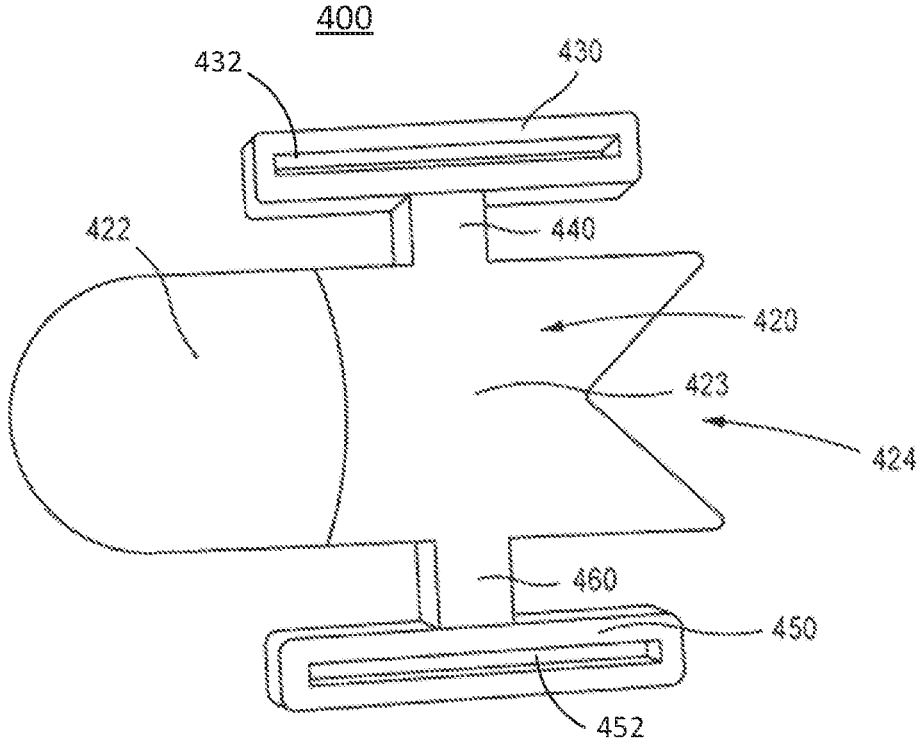
FIGS. 8-10 are bottom, bottom perspective, and top views of an oral device according to another embodiment.
Figure 9:
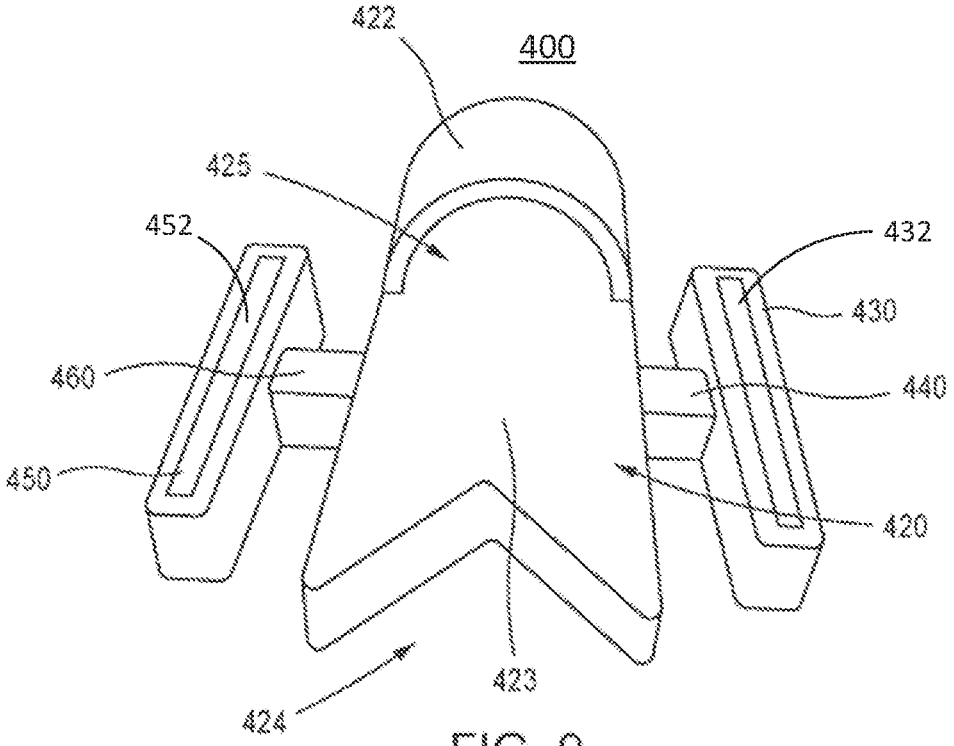
Figure 10:
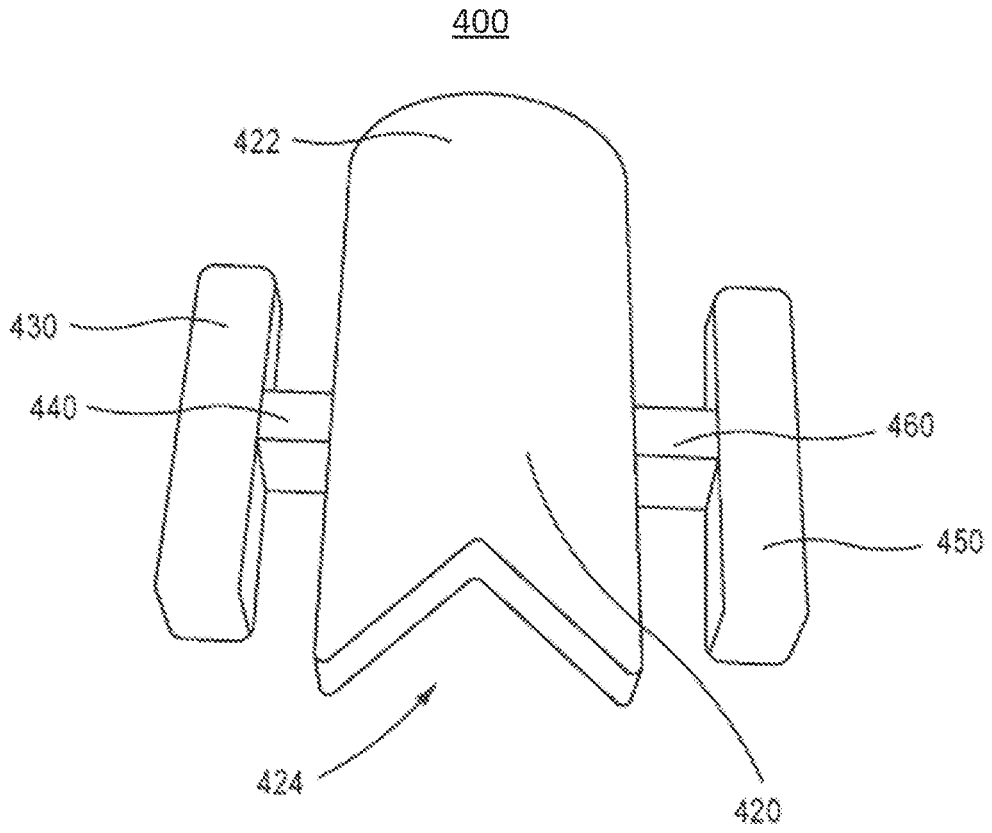

FIGS. 8-10 are bottom, bottom perspective, and top views, respectively, of an oral device 400. The oral device 400 can be the same or similar in structure and/or function to any of the oral devices described herein, such as, for example, oral device 100 and oral device 200. As shown in FIG. 8, which is a bottom view of the oral device 400, the oral device 400 includes a tongue protector 420, a left tooth protector 430, and a right tooth protector 450. The left tooth protector 430 and the right tooth protector 450 are coupled to the tongue protector 420 via a left coupler 440 and a right coupler 460, respectively.

The tongue protector 420 can include a tongue receptacle 422. The tongue receptacle 422 can define an interior space 425 (shown in FIG. 9) in which the tip of a user's tongue can be disposed during use. As shown in FIGS. 8-10, the tongue protector 420 can be shaped such that the tongue protector 420 includes a rounded front portion (e.g., formed by the tongue receptacle 422) intended for engagement with the tip of the user's tongue and a back portion 423 intended for engagement with the top side of the user's tongue. The back portion also includes a rear cut out 424 having a triangular shape. Although the back portion 423 is shown as having the shape shown in FIGS. 8-10, the back portion 423 can have any suitable shape, such as, for example, a rectangular shape.

The left tooth protector 430 and the right tooth protector 450 are configured to be secured to the teeth of the user. As shown in FIG. 8, the left tooth protector 430 and the right tooth protector 450 can each have a rectangular shape and can each define a tooth-receiving portion 432, 452 such that the left tooth protector and the right tooth protector can be slid over the teeth of the user. The left tooth protector 430 and the right tooth protector 450 can be configured to be secured to any suitable tooth or range of teeth. For example, in some embodiments, the left tooth protector 430 and the right tooth protector 450 can be shaped and sized such that the left tooth protector 430 and the right tooth protector 450 can be disposed over the left and right lower molars (e.g., the first and second premolars and first and second molars) and canines of the user, respectively. Said another way, the left tooth protector 430 and the right tooth protector 450 can be disposed over teeth on the left and right side of a user's mouth, respectively, leaving the user's incisors uncovered. In some embodiments, the left tooth protector 430 and the right tooth protector 450 can be shaped to be disposed over the user's range of teeth from the lower canine to the lower third molar (if the user has a lower third molar) on each side of the user's mouth. In some embodiments, the left tooth protector 430 and the right tooth protector 450 can only be disposed over the lower molars or the lower canines.

As described above, the left coupler 440 couples the left tooth protector 430 to the tongue protector 420, and the right coupler 460 couples the right tooth protector 450 to the tongue protector 420. Each of the left coupler 440 and the right coupler 460 can allow for limited movement of the tongue protector 420 relative to the left tooth protector 430 and the right tooth protector 450 (e.g., for speaking, eating, and/or drinking). As shown in FIG. 9, which is a bottom perspective view of the oral device 400, the left coupler 440 and the right coupler 460 can be fixedly attached to the left tooth protector 430 and the right tooth protector 450, respectively, and to the tongue protector 420. The left coupler 440 and the right coupler 460 can each provide an elastic support for the tongue protector 420 relative to the left tooth protector 430 and the right tooth protector 450. For example, the left coupler 440 and the right coupler 460 can each be formed of an elastomeric material.

In use, the oral device 400 can prevent the damage from teeth to teeth and/or teeth to tongue impact that can occur during biting or chewing (e.g., during a seizure), as with the previous embodiments.

As described above with reference to the oral device 100, the tongue protector 420, the tooth protectors 430, 450, and/or the couplers 440, 460 can be made of any suitable material(s). The material(s) can be selected based on considerations including: a) withstanding the force with which chewing and biting may occur during seizures; and b) efficacy in minimizing hypersalivation.

Figure 11:
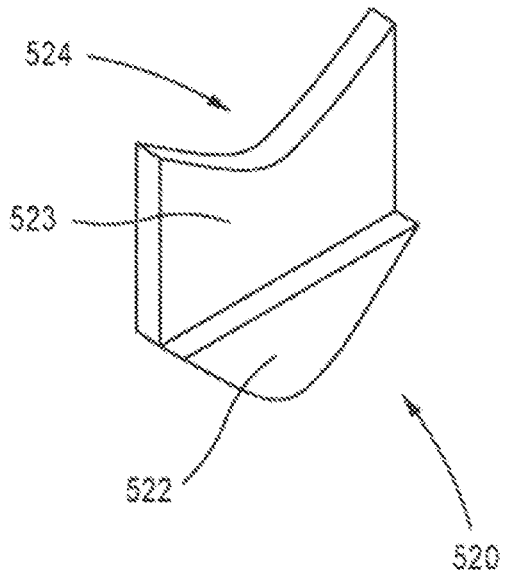
FIG. 11 is a schematic bottom perspective view of the tongue protector of an oral device according to another embodiment.

FIG. 11 is a schematic bottom perspective view of a tongue protector 520 of an oral device. The tongue protector 520 can be similar in structure and/or function to any of the tongue protectors described herein. For example, the tongue protector 520 can include a tongue receptacle 522. Additionally, the tongue protector 520 can be shaped such that the tongue protector 520 includes a rounded front portion (e.g., formed by the tongue receptacle 522) intended for engagement with the tip of the user's tongue and a back portion 523 intended for engagement with the top side of the user's tongue. The back portion also includes a rear cut out 524 having a curved shape.

Figure 12:
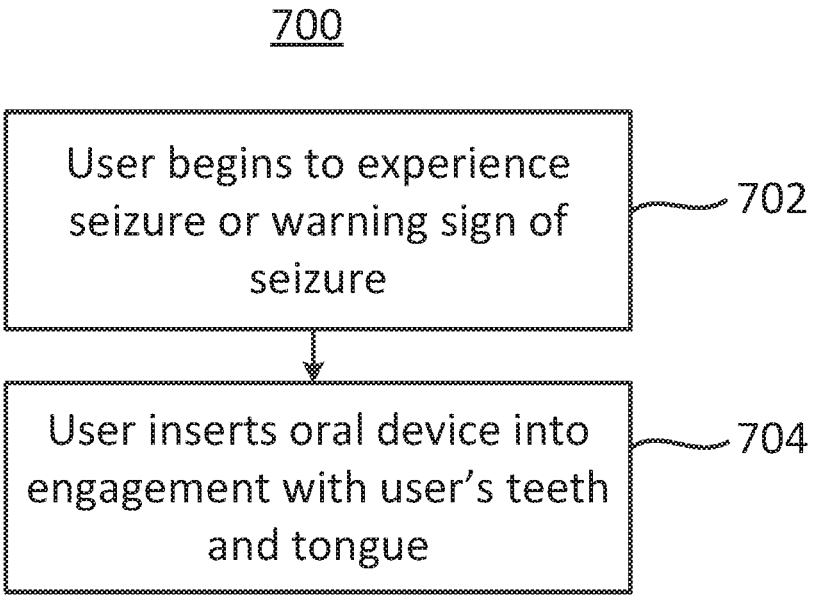
FIG. 12 is a flow chart illustrating a method according to an embodiment.

FIG. 12 is a flow chart illustrating a method 700 of protecting the teeth and controlling the tongue of a user using any of the oral devices described herein, such as the oral device 100 or the oral device 200. First, the user begins to experience a seizure or a warning sign of a seizure, at 702. The user then inserts an oral device into engagement with the user's teeth and tongue, at 704.

Figure 13:
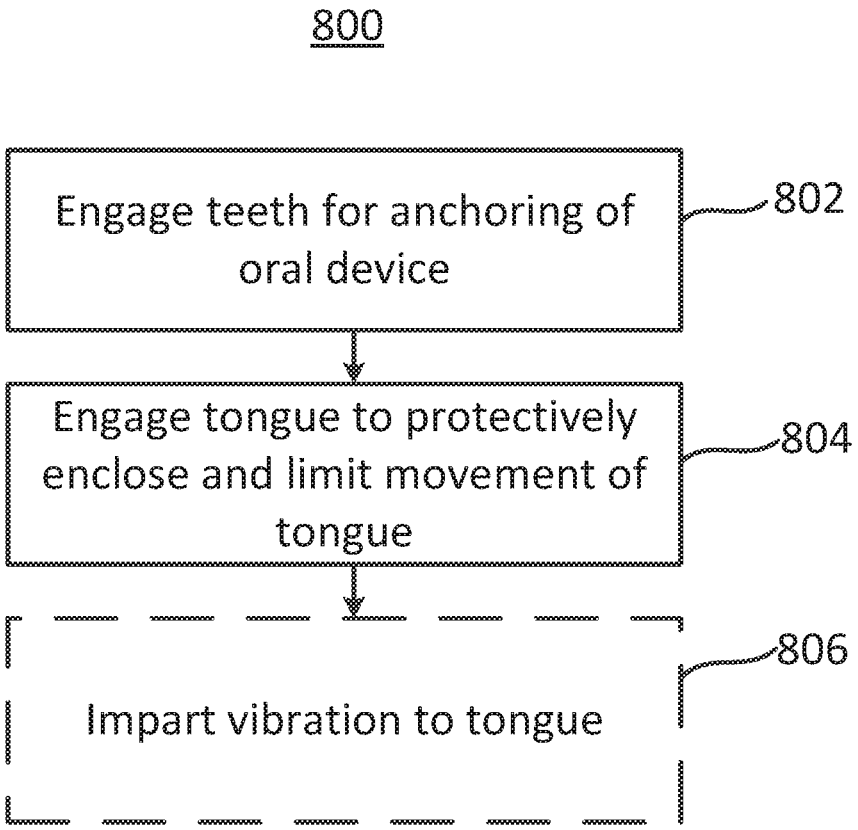
FIG. 13 is a flow chart illustrating a method according to an embodiment.

FIG. 13 is a flow chart illustrating a method 800 of use of an oral device, such as any of the oral devices described herein (e.g., oral device 100 or oral device 200). First, the teeth are engaged for anchoring of the oral device within the mouth, at 802. The tongue is then engaged such that the tongue is protectively enclosed and the movement of the tongue is limited, at 804. Optionally, vibration can be imparted to the tongue, at 806.

Figure 14:
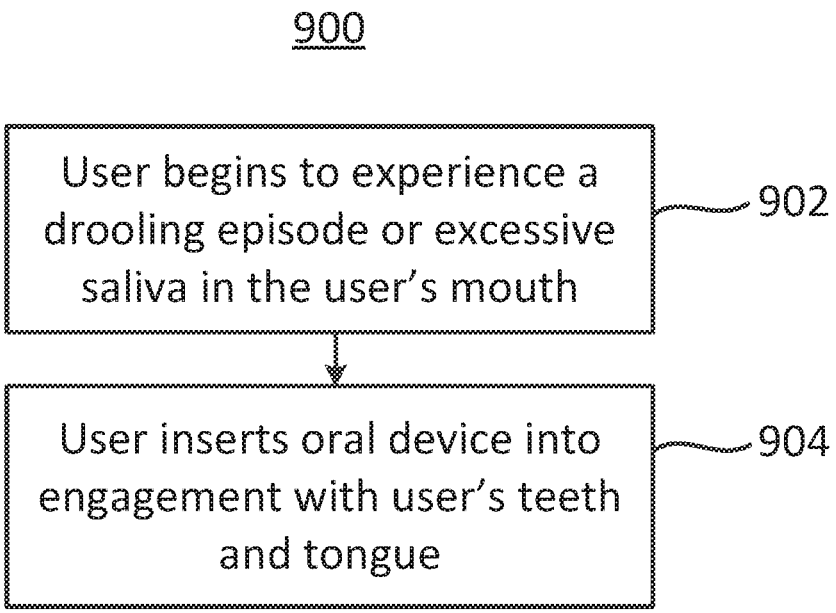
FIG. 14 is a flow chart illustrating a method according to an embodiment.

FIG. 14 is a flow chart illustrating a method 900 of treating hypersalivation using any of the oral devices described herein, such as the oral device 100 or the oral device 200. First, the user experiences a drooling episode or excessive saliva in the user's mouth, at 902. The user then inserts an oral device into engagement with the user's teeth and tongue, at 904.

Figure 15:
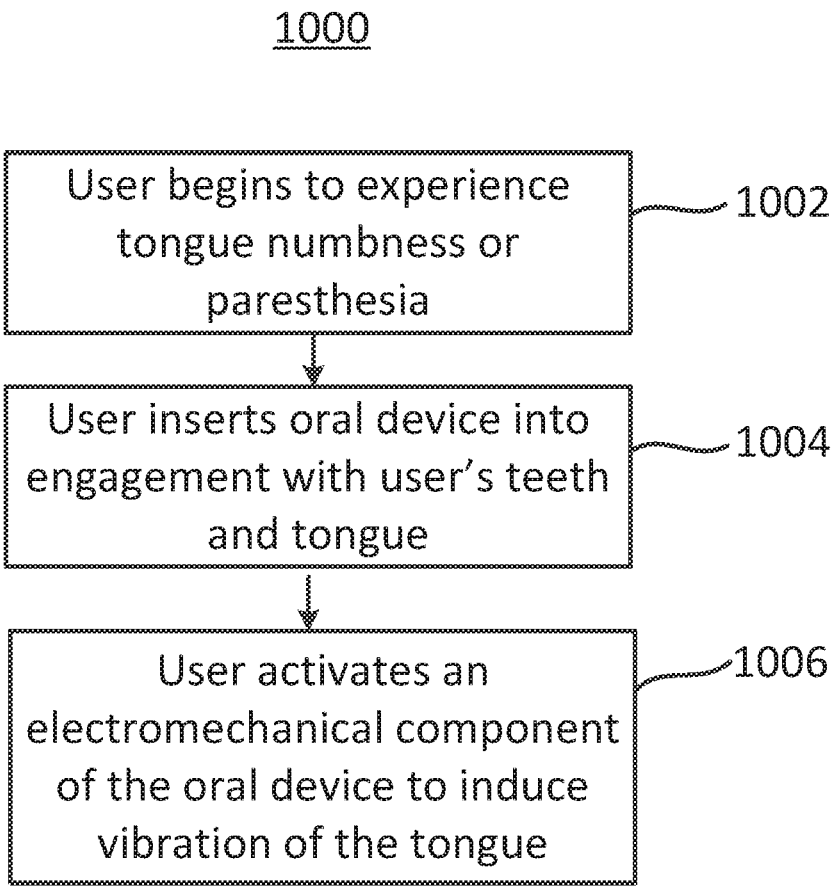
FIG. 15 is a flow chart illustrating a method according to an embodiment.

FIG. 15 is a flow chart illustrating a method 1000 of treating tongue numbness or paresthesia using any of the oral devices described herein, such as the oral device 100 or the oral device 200. First, the user experiences tongue numbness or paresthesia, such as following a stroke, at 1002. The user then inserts an oral device into engagement with the user's teeth and tongue, at 1004. The user then activates an electromechanical component of the oral device to induce vibration of the tongue, at 1006.

In some embodiments, the oral devices described herein, such as the oral device 100 or the oral device 200, can be used to treat ventilator-associated pneumonia (VAP). For example, a user (e.g., a patient in the intensive care unit (ICU)) can insert the oral device into engagement with the user's teeth and tongue. Alternatively, a healthcare provider (e.g., a doctor or a nurse) treating a patient on a ventilator in the ICU can insert the oral device into engagement with the user's teeth and tongue. The device can be ergonomically designed such that the ventilator tube and the device do not interfere with each other and such that the device can be easily administered or removed by a healthcare provider (e.g., the device may need to be changed or removed periodically for other procedures). The oral device can include and/or be formed of material configured to prevent bacteria growth within the mouth (e.g., anti-microbial material). As described herein for other embodiments, the oral device can include a sensor enabled, for example, to monitor or sense saliva production and/or bacteria growth. Additionally, as described herein for other embodiments, the oral device can include a drug delivery mechanism. For example, the oral device can be configured to dispense a cleansing agent within the mouth from a reservoir. In some embodiments, the oral device can dispense the drug from a reservoir disposed on any suitable portion of the device, such as on a tongue protector, a coupler, a tooth protector, and/or an anchor of the device. In some embodiments, the oral device can be configured to dispense the drug from the reservoir based, at least in part, on data collected by the sensor. The oral device can also be configured to dispense the drug from the reservoir based, at least in part, on a timer.

Additionally, although some oral devices shown herein are shown as having edges formed as about 90 degrees or as acute angles (e.g., FIGS. 16A-20), in some embodiments the edges of an oral device, such as the edges of a tongue protector or a coupler of any of the oral devices described herein, can be beveled or rounded. For example, the edges of an oral device able to be contacted during use by the tongue of the wearer can be beveled or rounded.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above.

Where embodiments described above indicate certain components arranged in certain orientations or positions, the arrangement of components may be modified. While the embodiments have been particularly shown and described, it will be understood that various changes in form and details may be made. Any portion of the apparatus and/or methods described herein may be combined in any combination, except mutually exclusive combinations. The embodiments described herein can include various combinations and/or sub-combinations of the functions, components and/or features of the different embodiments described.

The invention claimed is:

1. An oral device, comprising:

a tongue protector configured to prevent damaging contact between teeth and a distalmost tip of a tongue of a user, the tongue protector having a front portion and a back portion, the front portion forming a tongue receptacle configured to receive and enclose the distalmost tip of the tongue of the user within an interior cavity defined by the tongue receptacle, the back portion extending proximally from the front portion and configured to engage only a top surface of the tongue of the user such that a portion of the top surface of the tongue of the user engaged with the tongue protector has a greater length than a portion of a bottom surface of the tongue of the user engaged with the tongue protector;

a left tooth protector configured to be disposed over only left lower molars and a left lower canine of the user such that left upper molars and a left upper canine of the user cannot contact the left lower molars and the left lower canine during a biting motion of the user, the left tooth protector having a distal free end;

a right tooth protector configured to be disposed over only right lower molars and a right lower canine of the user such that right upper molars and a right upper canine of the user cannot contact the right lower molars and the right lower canine during the biting motion, the right tooth protector having a distal free end spaced from the distal free end of the left tooth protector such that no portion of the left tooth protector or the right tooth protector contacts any distal surface of one or more top incisors of the user or any distal surface of one or more bottom incisors of the user;

an elastic left coupler coupled to the left tooth protector and the back portion of the tongue protector; and an elastic right coupler coupled to the right tooth protector and the back portion of the tongue protector, the left coupler and right coupler being configured to allow limited relative movement of the tongue protector with respect to the left tooth protector and the right tooth protector while retaining the tongue protector in the user's mouth such that the user's tongue can transition the tongue protector between a position in which the tongue receptacle is proximal of at least one incisor of the user and a position in which at least a portion of the tongue receptacle is distal of the at least one incisor of the user when the left tooth protector is disposed over the left lower molars and the left lower canine and the right tooth protector is disposed over the right lower molars and the right lower canine, the left tooth protector coupled to the tongue protector only via the left coupler, the right tooth protector coupled to the tongue protector only via the right coupler, the left tooth protector coupled to the right tongue protector only via the left coupler, the tongue protector, and the right coupler such that 1) no portion of the oral device contacts any distal surface of the one or more top incisors of the user or any distal surface of the one or more bottom incisors of the user, 2) no portion of the oral device is disposed between any distal surface of the one or more top incisors of the user and a lip portion of the user adjacent the distal surface of the one or more top incisors of the user, and 3) no portion of the oral device is disposed between any distal surface of the one or more bottom incisors of the user and a lip portion of the user adjacent the distal surface of the one or more bottom incisors of the user, the oral device being formed entirely of a polymer, the oral device configured, in response to the user experiencing at least one of a symptom of a seizure or a warning sign of a seizure, to be inserted into the user's mouth with the left tooth protector and the right tooth protector coupled to the tongue protector via the left coupler and the right coupler, respectively, such that the left tooth protector can be urged into engagement with the left lower molars and the left lower canine of the user and the right tooth protector can be urged into engagement with the right lower molars and right lower canine of the user as the distalmost tip of the user's tongue is received within the interior cavity defined by the tongue receptacle.

2. The oral device of claim 1, wherein the polymer is formulated to absorb saliva of the user.

3. The oral device of claim 1, wherein the tongue protector includes a plurality of perforations therethrough configured to permit liquid to pass through the tongue protector and reach the tongue of the user, each perforation of the plurality of perforations configured such that a central axis of each perforation intersects the tongue of the user when the distalmost tip of the tongue of the user is enclosed by the tongue receptacle.

4. The oral device of claim 1, wherein at least one of the left coupler, the right coupler, or the tongue protector define a cavity within which an electromechanical component configured to induce vibration of the tongue protector can be encapsulated.

5. The oral device of claim 1, wherein the left coupler is less thick from a top surface to a bottom surface of the left coupler than a maximum thickness of the left tooth protector from a top surface to a bottom surface of the left tooth protector.

6. The oral device of claim 1, wherein the left tooth protector has a larger maximum proximal to distal length than a maximum proximal to distal length of the left coupler.

7. The oral device of claim 1, wherein the left coupler is more elastic than the left tooth protector and the right coupler is more elastic than the right tooth protector.

8. The oral device of claim 7, wherein the left coupler and the right coupler are more elastic than the tongue protector.

9. The oral device of claim 1, wherein the left tooth protector is spaced from the tongue protector such that a gap is defined between the left tooth protector and the tongue protector, the left coupler extending from a peripheral edge of the back portion of the tongue protector to a peripheral edge of the left tooth protector across a portion of the gap.

10. The oral device of claim 1, wherein the tongue protector defines a rear cut out in a proximal end of the tongue protector, the rear cut out having a triangular shape.

11. The oral device of claim 1, wherein the tongue receptacle is configured to cover at least half of the top surface of the tongue of the user.

12. The oral device of claim 1, wherein the back portion of the tongue protector has a maximum width that is less than a width of the top surface of the tongue of the user.

13. The oral device of claim 1, wherein the back portion of the tongue protector has a rectangular shape.

14. An oral device, comprising:

a tongue protector configured to prevent damaging contact between teeth and a distalmost tip of a tongue of a user, the tongue protector having a front portion and a back portion, the front portion forming a tongue receptacle configured to receive and enclose the distalmost tip of the tongue of the user within an interior cavity defined by the tongue receptacle, the back portion extending proximally from the front portion and configured to engage only a top surface of the tongue of the user such that a portion of the top surface of the tongue of the user engaged with the tongue protector has a greater length than a portion of a bottom surface of the tongue of the user engaged with the tongue protector, the tongue protector having a plurality of perforations therethrough configured to permit liquid to pass through the tongue protector and reach the tongue of the user, each perforation of the plurality of perforations configured such that a central axis of each perforation intersects the tongue of the user when the distalmost tip of the tongue of the user is enclosed by the tongue receptacle;

a left tooth protector configured to be disposed over only some of the left lower teeth of the user such that left upper teeth of the user cannot contact the some of the left lower teeth of the user during a biting motion of the user, the left tooth protector having a distal free end;

a right tooth protector configured to be disposed over only some of the right lower teeth of the user such that right upper teeth of the user cannot contact the some of the right lower teeth during the biting motion, the right tooth protector having a distal free end spaced from the distal free end of the left tooth protector such that no portion of the left tooth protector or the right tooth protector contacts any distal surface of one or more top incisors of the user or any distal surface of one or more bottom incisors of the user;

an elastic left coupler coupled to the left tooth protector and the back portion of the tongue protector; and an elastic right coupler coupled to the right tooth protector and the back portion of the tongue protector, the left coupler and right coupler being configured to allow limited relative movement of the tongue protector with respect to the left tooth protector and the right tooth protector while retaining the tongue protector in the user's mouth such that the user's tongue can transition the tongue protector between a position in which the tongue receptacle is proximal of at least one incisor of the user and a position in which at least a portion of the tongue receptacle is distal of the at least one incisor of the user when the left tooth protector is disposed over the some of the left lower teeth and the right tooth protector is disposed over the some of the right lower teeth, the left tooth protector coupled to the tongue protector only via the left coupler, the right tooth protector coupled to the tongue protector only via the right coupler, the left tooth protector coupled to the right tooth protector only via the left coupler, the tongue protector, and the right coupler such that 1) no portion of the oral device contacts any distal surface of the one or more top incisors of the user or any distal surface of the one or more bottom incisors of the user, 2) no portion of the oral device is disposed between any distal surface of the one or more top incisors of the user and a lip portion of the user adjacent the distal surface of the one or more top incisors of the user, and 3) no portion of the oral device is disposed between any distal surface of the one or more bottom incisors of the user and a lip portion of the user adjacent the distal surface of the one or more bottom incisors of the user, the oral device being formed entirely of a polymer formulated to absorb saliva of the user, the oral device configured, in response to the user experiencing at least one of a symptom of a seizure or a warning sign of a seizure, to be inserted into the user's mouth with the left tooth protector and the right tooth protector coupled to the tongue protector via the left coupler and the right coupler, respectively, such that the left tooth protector can be urged into engagement with the some of the left lower teeth and the right tooth protector can be urged into engagement with the some of the right lower teeth as the distalmost tip of the user's tongue is received within the interior cavity defined by the tongue receptacle.

15. The oral device of claim 14, wherein the left tooth protector is configured to cover only the left lower molars and left lower canine of the user.

16. An oral device, comprising:

a tongue protector configured to prevent damaging contact between teeth and a distalmost tip of a tongue of a user, the tongue protector having a front portion and a back portion, the front portion forming a tongue receptacle configured to receive and enclose the distalmost tip of the tongue of the user within an interior cavity defined by the tongue receptacle, the back portion extending proximally from the front portion and configured to engage only a top surface of the tongue of the user such that a portion of the top surface of the tongue of the user engaged with the tongue protector has a greater length than a portion of a bottom surface of the tongue of the user engaged with the tongue protector, the tongue protector having a plurality of perforations therethrough configured to permit liquid to pass through the tongue protector and reach the tongue of the user, each perforation of the plurality of perforations configured such that a central axis of each perforation intersects the tongue of the user when the distalmost tip of the tongue of the user is enclosed by the tongue receptacle;

a left tooth protector configured to be disposed over only some of the left lower teeth of the user such that left upper teeth of the user cannot contact the some of the left lower teeth of the user during a biting motion of the user, the left tooth protector having a distal free end;

a right tooth protector configured to be disposed over only some of the right lower teeth of the user such that right upper teeth of the user cannot contact the some of the right lower teeth during the biting motion, the right tooth protector having a distal free end spaced from the distal free end of the left tooth protector such that no portion of the left tooth protector or the right tooth protector contacts any distal surface of one or more top incisors of the user or any distal surface of one or more bottom incisors of the user;

an elastic left coupler coupled to the left tooth protector and the back portion of the tongue protector, the left tooth protector being spaced from the tongue protector such that a gap is defined between the left tooth protector and the tongue protector, the left coupler extending from a peripheral edge of the back portion of the tongue protector to a peripheral edge of the left tooth protector across a portion of the gap; and an elastic right coupler coupled to the right tooth protector and the back portion of the tongue protector, the right tooth protector being spaced from the tongue protector such that a gap is defined between the right tooth protector and the tongue protector, the right coupler extending from a peripheral edge of the back portion of the tongue protector to a peripheral edge of the right tooth protector across a portion of the gap, the left coupler and right coupler being configured to allow limited relative movement of the tongue protector with respect to the left tooth protector and the right tooth protector while retaining the tongue protector in the user's mouth such that the user's tongue can transition the tongue protector between a position in which the tongue receptacle is proximal of at least one incisor of the user and a position in which at least a portion of the tongue receptacle is distal of the at least one incisor of the user when the left tooth protector is disposed over the some of the left lower teeth and the right tooth protector is disposed over the some of the right lower teeth, the left tooth protector coupled to the tongue protector only via the left coupler, the right tooth protector coupled to the tongue protector only via the right coupler, the left tooth protector coupled to the right tooth protector only via the left coupler, the tongue protector, and the right coupler such that 1) no portion of the oral device contacts any distal surface of the one or more top incisors of the user or any distal surface of the one or more bottom incisors of the user, 2) no portion of the oral device is disposed between any distal surface of the one or more top incisors of the user and a lip portion of the user adjacent the distal surface of the one or more top incisors of the user, and 3) no portion of the oral device is disposed between any distal surface of the one or more bottom incisors of the user and a lip portion of the user adjacent the distal surface of the one or more bottom incisors of the user, the oral device being formed entirely of a polymer formulated to absorb saliva of the user, the oral device configured, in response to the user experiencing at least one of a symptom of a seizure or a warning sign of a seizure, to be inserted into the user's mouth with the left tooth protector and the right tooth protector coupled to the tongue protector via the left coupler and the right coupler, respectively, such that the left tooth protector can be urged into engagement with the some of the left lower teeth and the right tooth protector can be urged into engagement with the some of the right lower teeth as the distalmost tip of the user's tongue is received within the interior cavity defined by the tongue receptacle.

17. The oral device of claim 16, wherein the left coupler is less thick from a top surface to a bottom surface of the left coupler than a maximum thickness of the left tooth protector from a top surface to a bottom surface of the left tooth protector.

18. The oral device of claim 16, wherein the left coupler and the right coupler are more elastic than the tongue protector.

19. The oral device of claim 16, wherein the tongue protector defines a rear cut out in a proximal end of the tongue protector, the rear cut out having a triangular shape.

20. The oral device of claim 16, wherein the tongue receptacle is configured to cover at least half of the top surface of the tongue of the user.

* * * * *